United States Patent [19]

Salathé et al.

[11] 4,444,564

[45] Apr. 24, 1984

[54] PROCESS FOR DYEING FIBER MATERIAL MADE OF NATURAL POLYAMIDES WITH ANIONIC WOOL DYES AT pH 4.5 TO 5.5 IN THE PRESENCE OF A DYEING ASSISTANT

[75] Inventors: Heinz Salathé, Bretzwil, Switzerland; Hermann Flensberg, Weil am Rhein; Harry Schaetzer, Wehr, both of Fed. Rep. of Germany

[73] Assignee: Ciba-Geigy Corporation, Ardsley, N.Y.

[21] Appl. No.: 474,352

[22] Filed: Mar. 11, 1983

[30] Foreign Application Priority Data

Mar. 12, 1982 [CH] Switzerland ..... 1556/82

[51] Int. Cl.[3] ..... D06P 1/60; D06P 3/06

[52] U.S. Cl. ..... 8/588; 8/543; 8/587; 8/604; 8/606; 8/658; 8/680; 8/685; 8/917

[58] Field of Search ..... 8/587, 604, 685, 588, 8/606

[56] References Cited

U.S. PATENT DOCUMENTS 3,529,922 9/1970 Berger et al. ..... 8/604

FOREIGN PATENT DOCUMENTS 815940 9/1966 Canada .
1160343 8/1969 United Kingdom .
2002426 2/1979 United Kingdom .
2038375 7/1980 United Kingdom .

*Primary Examiner*—A. Lionel Clingman
*Attorney, Agent, or Firm*—Wenderoth, Lind & Ponack

[57] ABSTRACT

The invention relates to a process for the non-skittery and level dyeing of fibre material made of natural polyamides, with dyes or mixtures of dyes in the presence of a mixture of dyeing assistants, which comprises using for dyeing these materials an aqueous liquor which contains at least one anionic wool dye which, under the defined dyeing conditions at 1/1 standard depth, exhausts to at least 95%, and a dyeing assistant mixture containing an anionic compound of the formula (1)

in which R is an alkyl or alkenyl radical having 12 to 22 carbon atoms, M is hydrogen, an alkali metal or ammonium, and m and n are integers such that the sum of m and n is 2 to 14, a quaternary compound of the formula (2)

in which R′, independently of R, is what R has been defined as, A is an anion, Q is a substituted or unsubstituted alkyl radical, and p and q are integers such that the sum of p and q is 20 to 50 , and a non-ionic compound of the formula (3)

in which R″, independently of R, is what R has been defined as, and x and y are integers such that the sum of x and y is 80 to 140, and which liquor can, if desired, also contain an ammonium or alkali metal salt, and finishing the dyeing regardless of its depth at pH 4.5–5.5 and at a temperature of 95° to 105° C. The process according to the invention is suitable for dyeing natural polyamide materials, especially wool, but also wool/nylon, wool/polyester, wool/cellulose or wool/polyacrylonitrile blends and silk, giving, with various types of dye or mixtures of dyes of identical or different dye types, non-skittery and level dyeings having good fastness properties.

23 Claims, No Drawings

PROCESS FOR DYEING FIBER MATERIAL MADE OF NATURAL POLYAMIDES WITH ANIONIC WOOL DYES AT pH 4.5 TO 5.5 IN THE PRESENCE OF A DYEING ASSISTANT

The present invention relates to a unified, novel process for the non-skittery and level dyeing of natural polyamide materials with anionic wool dyes of various dye classes, in pale to dark shades from an aqueous liquor, in which, regardless of the depth of the dyeing or the class of dye used, the dyeing is carried out at a pH which preserves the quality of the natural polyamide fibre material, the dyebath is virtually completely exhausted, and the dyeing has good all-round fastness properties, in particular good wet fastness and good light fastness properties, and to material dyes by means of the novel process.

The disadvantage of existing methods of dyeing natural polyamides is that not only pale and dark shades but also the use of dyes of different classes require dyeing at different pH values. For instance, it has been disclosed in the literature that good-levelling acid dyes are used at pH 2–3.5, acid dyes fast to milling at pH 4–5, acid dyes very fast to milling at pH 6–7, 1:2 metal complex dyes without sulfo groups at pH 5–7, 1:2 metal complex dyes having sulfo groups at pH 4–7, 1:1 metal complex dyes at pH 1.9–2.8 and reactive dyes at pH 4.5–7.

The pH of the dyebath in dyeing natural polyamide materials, in particular in dyeing wool, is of crucial importance besides the dyeing temperature and the dyeing time, since wool, in particular, is strongly attacked in a strongly acid as well as an alkaline pH range.

A further disadvantage of existing methods of dyeing wool in particular, is that dyeing assistants which are matched to the particular class of dye are used to level out affinity differences in the wool (dichroism), since the dichroism depends on the hydrophilic nature of the dyes used; i.e. the dyeing assistants used in the existing dyeing methods cannot be used with equal success with every class of dye. In particular, the combination of hydrophilic dyes with more hydrophobic dyes gives rise to irregularities in hue and shade. In many cases, moreover, the levelness of dyed natural polyamide materials is unsatisfactory.

We have now surprisingly found a unified process which is free of the disadvantages and problems mentioned and which permits natural polyamide to be dyed in a simple manner in the fibre-protective pH range from 4.5 to 5.5 regardless of the desired depth and regardless of the type of dye used, and even with the use of mixtures of various types of dye.

Accordingly, the present invention relates to a process for the non-skittery and level dyeing of fibre material made of natural polyamides with dyes or mixtures of dyes in the presence of a mixture of dyeing assistants, which comprises using for dyeing these materials an aqueous liquor which contains at least one anionic wool dye which, under the defined dyeing conditions at 1/1 standard depth, exhausts to at least 95%, and a dyeing assistant mixture containing an anionic compound of the formula

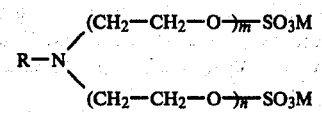

(1)

in which R is an alkyl or alkenyl radical having 12 to 22 carbon atoms, M is hydrogen, an alkali metal or ammonium, and m and n are integers such that the sum of m and n is 2 to 14, a quaternary compound of the formula

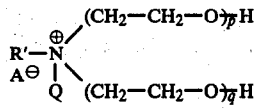

(2)

in which R′, independently of R, is what R has been defined as, A is an anion, Q is a substituted or unsubstituted alkyl radical, and p and q are integers such that the sum of p and q is 20 to 50, and a non-ionic compound of the formula

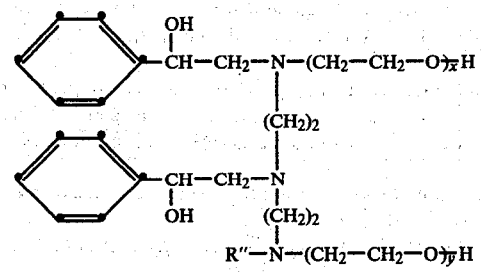

(3)

in which R″, independently of R, is what R has been defined as, and x and y are integers such that the sum of x and y is 80 to 140, and which can, if desired, also contain an ammonium or alkali metal salt, and finishing the dyeing regardless of its depth at pH 4.5–5.5, preferably at pH 4.6–4.9, and at a temperature of 95° to 105° C.

The anionic wool dyes which be used can belong to a very wide variety of class of dyes, and they can, if desired, also contain one or more sulfonic acid groups and, if desired, one or more fibre-reactive groups. They are in particular triphenylmethane dyes having at least two sulfonic acid groups, monoazo and disazo dyes which are free of heavy metals but which contain, in every case, one or more sulfonic acid groups and can, if desired, also contain one or more fibre-reactive groups, and heavy metal-, namely copper-, chromium-, nickel- or cobalt-containing monoazo, disazo, azomethine and formazan dyes, in particular metallised dyes which contain bonded to a metal atom two molecules of azo dye or one molecule of azo dye and one molecule of azomethine dye, in particular those which contain as ligands monoazo and/or disazo dyes and/or azomethine dyes and as central metal ion a chromium or cobalt ion, and also anthraquinone dyes, in particular 1-amino-4-arylaminoanthraquinone-2-sulfonic acids or 1,4-diarylamino- or 1-cycloalkylamino-4-arylaminoanthraquinonesulfonic acids. Fibre-reactive groups are understood as meaning those groups which enter a covalent bond with the natural polyamide material.

Dyes which contain one or more fibre-reactive groups are preferably used in the process according to the invention combined with non-fibre-reactive dyes.

The amounts in which the dyes are used in the dyebaths can vary within wide limits according to the desired depth of shade, but amounts of 0.001 to 10 percent by weight, relative to the goods, of one or more dyes are generally advantageous.

1/1 standard depth is understood as meaning the depth of shade designated 1/1 in DIN (German standard) 54,000.

To exhaust to at least 95% means that less than 5% of the amount of dye used in the process according to the invention is left behind in the bath in the course of the dyeing.

In the process according to the invention, it is also possible, if desired, to use mixtures of anionic wool dyes. A preferred mixture of anionic wool dyes of the type defined contains (a) at least two dyes; or (b) at least three dyes; or (c) for trichromatic dyeing, at least three dyes from among yellow- or orange-, red- and blue-dyeing dyes.

Trichromatic dyeing is understood as meaning the additive colour mixture of suitably chosen yellow- or orange-, red- and blue-dyeing dyes with which any desired shade of the visible colour spectrum can be matched by a suitable choice of the quantities of the dyes.

The process according to the invention preferably uses anionic wool dyes which, under the defined dyeing conditions at 1/1 standard depth, exhaust to at least 97%.

In particular the following dye classes are suitable for use as anionic wool dyes:

(a) triphenylmethane dyes having at least two sulfonic acid groups, of the formula

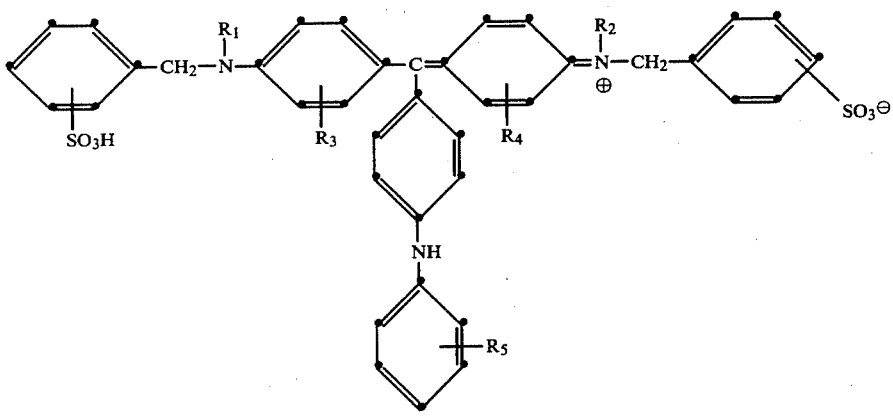

(4)

in which $R_1$, $R_2$, $R_3$ and $R_4$ independently of each other are $C_{1-4}$-alkyl and $R_5$ is $C_{1-4}$-alkyl, $C_{1-4}$-alkoxy or hydrogen;

(b) monoazo and disazo dyes of the formulae

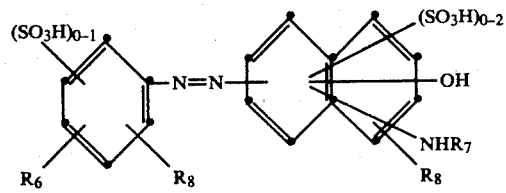

(5)

in which $R_6$ is a fibre-reactive group bonded via a —NH— group, benzoylamino, phenoxy, chlorophenoxy, dichlorophenoxy or methylphenoxy, $R_7$ is hydrogen, benzoyl, phenyl, $C_{1-4}$-alkyl, phenylsulfonyl, methylphenylsulfonyl or a fibre-reactive group which is or is not bonded via aminobenzoyl, and the substituents $R_8$ are independently of each other hydrogen or a phenylaminosulfonyl or N-phenyl-N-methylaminosulfonyl radical;

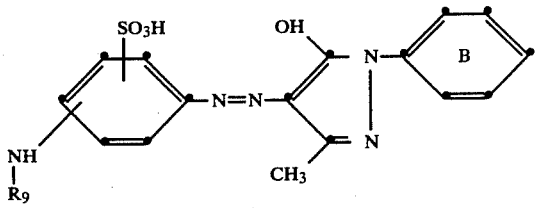

(6)

in which $R_9$ is a fibre-reactive group and the phenyl ring B can be substituted by halogen, $C_{1-4}$-alkyl and sulfo;

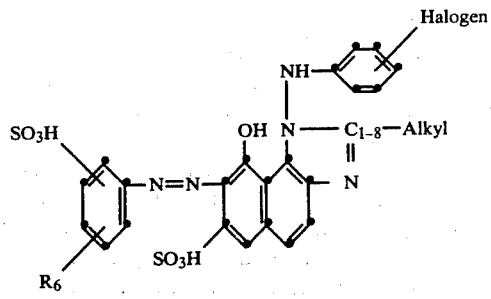

(7)

in which $R_6$ is as defined under formula (5);

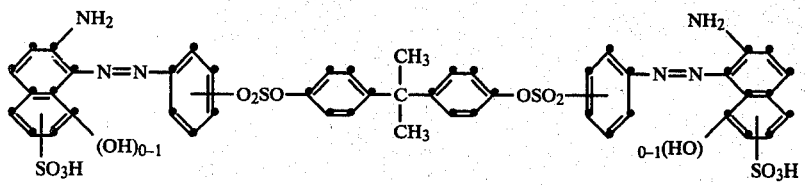

(8)

(c) 1:2 metal complex dyes such as the 1:2 chromium complex dyes of azo and azomethine dyes of the formula

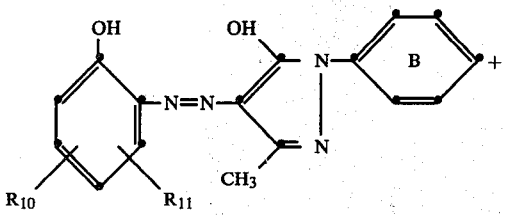

(9)

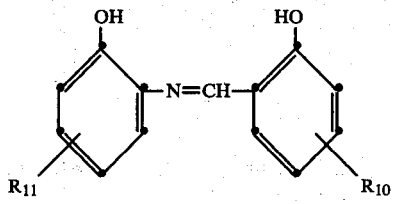

in which $R_{10}$ is hydrogen, sulfo or phenylazo, $R_{11}$ is hydrogen or nitro, and the phenyl ring B can contain the substituents specified under formula (6);

(d) 1:2 metal complex dyes such as the symmetrical 1:2 chromium complex dyes of azo dyes of the formulae

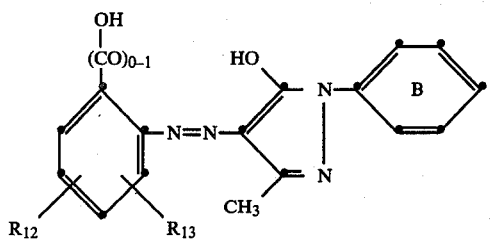

(10)

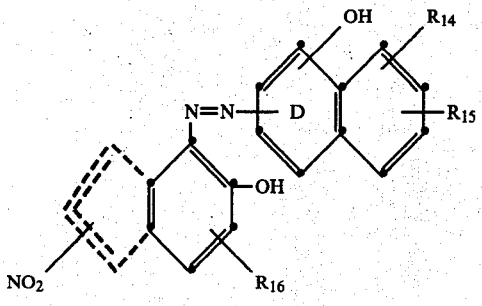

(11)

in which $R_{14}$ is hydrogen, $C_{1-4}$-alkoxycarbonylamino, benzoylamino, $C_{1-4}$-alkylsulfonylamino, phenylsulfonylamino, methylphenylsulfonylamino or halogen, $R_{15}$ is hydrogen or halogen, and $R_{16}$ is $C_{1-4}$-alkylsulfonyl, $C_{1-4}$-alkylaminosulfonyl, phenylazo, sulfo or $-SO_2NH_2$, and where the hydroxyl group in the benzo ring D is bonded in o-position relative to the azo bridge to the benzo ring D; the symmetrical 1:2 cobalt complexes of azo dyes of the formulae

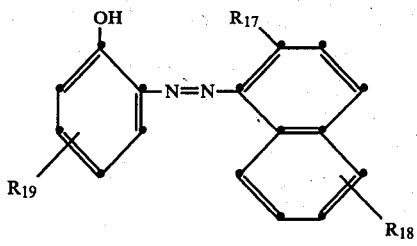

(12)

in which $R_{17}$ is the —OH or $NH_2$ group, $R_{18}$ is hydrogen or $C_{1-4}$-alkylaminosulfonyl, and $R_{19}$ is nitro or $C_{1-4}$-alkoxy-$C_{1-4}$-alkyleneaminosulfonyl;

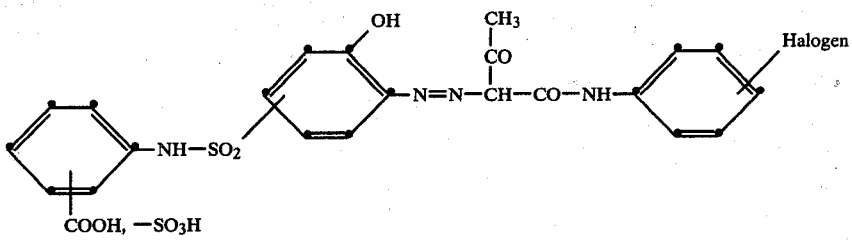

(13)

in which the phenyl ring B can contain the substituents specified under formula (6) and $R_{12}$ and $R_{13}$ independently of each other are hydrogen, nitro, sulfo, halogen, $C_{1-4}$-alkylsulfonyl, $C_{1-4}$-alkylaminosulfonyl or $-SO_2NH_2$;

the asymmetrical 1:2 metal complex dyes such as the 1:2 chromium complex dyes of azo dyes of the formulae (14)

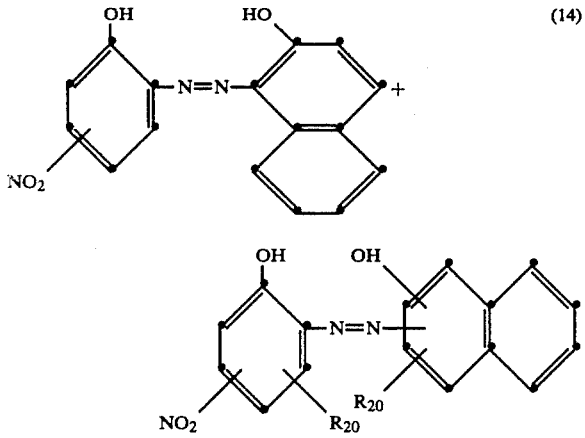

in which one of the substituents $R_{20}$ is hydrogen and the other is sulfo;

(15)

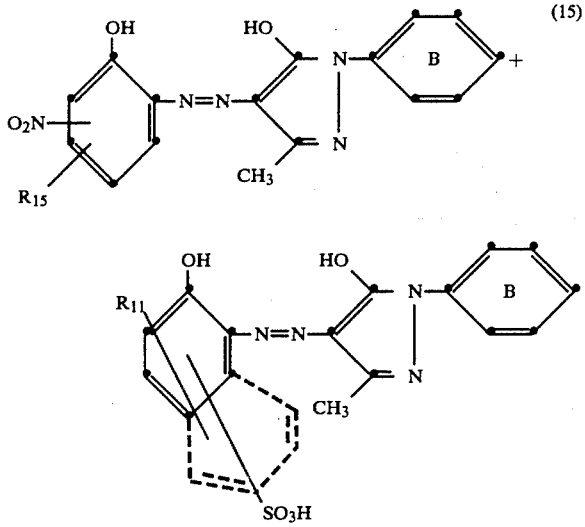

in which $R_{11}$ is as defined under formula (9) and $R_{15}$ is as defined under formula (11), and the phenyl rings B independently of each other can contain the substituents specified under formula (6);

(16)

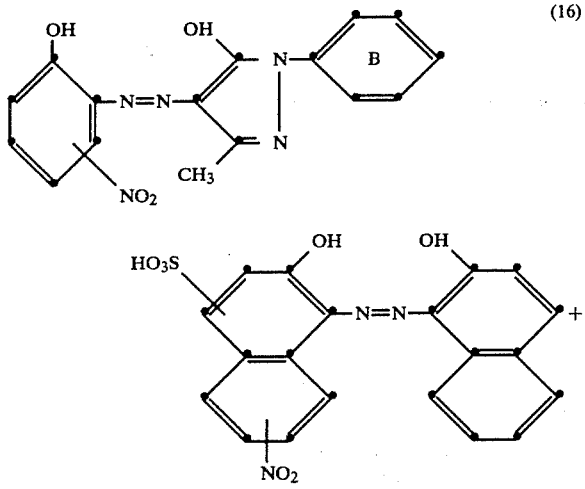

-continued (17)

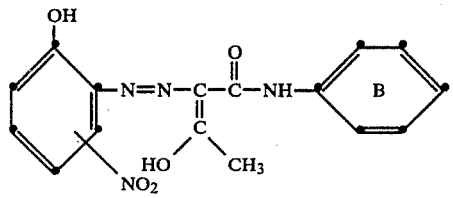

(18)

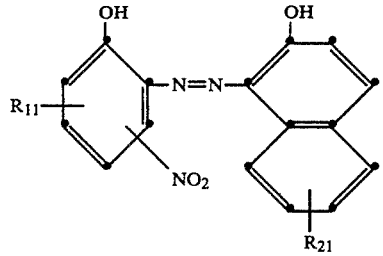

(19)

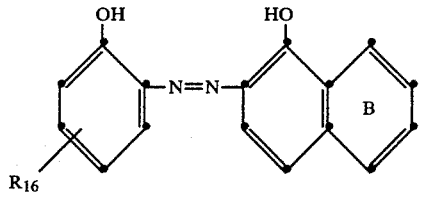

in which the phenyl ring B in the formulae (16), (17) and (19) can contain the substituents specified under formula (6), $R_{11}$ is as defined under formula (9), $R_{21}$ is hydrogen, methoxycarbonylamino or acetylamino, and $R_{16}$ is as defined under formula (11); 1:2 chromium complex dyes of azo dyes of the formulae (10)+(11); and 1:2 chromium mixed complexes of azo dyes of the formulae (10) and (11); and (e) anthraquinone dyes of the formulae (20)

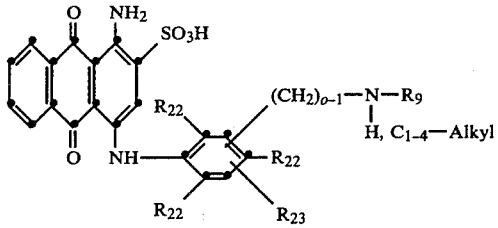

in which $R_9$ is as defined under formula (6), the $R_{22}$s independently of each other are hydrogen or $C_{1-4}$-alkyl, and $R_{23}$ is hydrogen or sulfo;

(21)

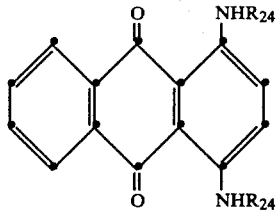

in which the substituents $R_{24}$ independently of each other are cyclohexyl or the diphenyl ether radical which can be substituted by sulfo or the radical $—CH_2NH—R_9$ in which $R_9$ is as defined under formula (6); and

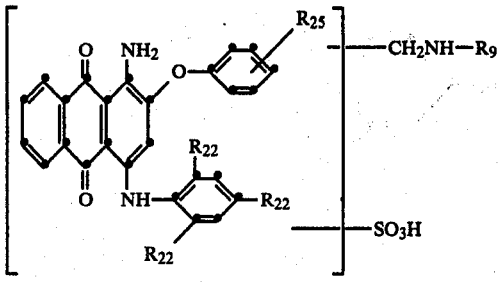

(22)

in which $R_9$ is as defined under formula (6), $R_{22}$ is as defined under formula (20), and $R_{25}$ is $C_{4-8}$-alkyl.

Examples of suitable fibre-reactive groups in the formulae shown are those of the aliphatic series, such as acryloyl, mono-, di- or tri-chloro- or mono-, di- or tri-bromo-acryloyl or -methacryloyl, such as —CO—CH=CH—Cl, —CO—CCl=$CH_2$, —CO—CH=CHBr, —COCBr=$CH_2$, —CO—CBr=CHBr, —CO—CCl=CH—$CH_3$ and also —CO—CCl=CH—COOH, —CO—CH=C-Cl—COOH, 4-chloropropionyl, 3-phenylsulfonylpropionyl, 3-methylsulfonylpropionyl, β-sulfatoethylaminosulfonyl, vinylsulfonyl, β-chloroethylsulfonyl, β-sulfatoethylsulfonyl, β-methylsulfonylethylsulfonyl, β-phenylsulfonylethylsulfonyl, 2-fluoro-2-chloro-3,3-difluorocyclobutane-1-carbonyl, 2,2,3,3-tetrafluorocyclobutane-1-carbonyl or -1-sulfonyl, β-(2,2,3,3-tetrafluorocyclobut-1-yl)-acryloyl, α- or β-alkyl- or arylsulfonylacryloyl, such as α- or β-methylsulfonylacryloyl.

Reactive radicals which are particularly suitable for wool are chloroacetyl, bromoacetyl, α,β-dichloro- or α,β-dibromo-propionyl, α-chloro- or α-bromo-acryloyl, 2,4-difluoro-5-chloropyrimid-6-yl, 2,4,6-trifluoropyrimid-5-yl, 2,4-dichloro-5-methylsulfonylpyrimidin-6-yl, 2-fluoro-4-methyl-5-chloropyrimid-6-yl, 2,4-difluoro-5-methylsulfonylpyrimid-6-yl, 2,4-difluorotriazin-6-yl and fluorotriazinyl radicals of the formula

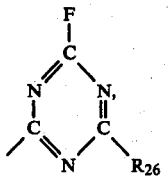

in which $R_{26}$ is a substituted or unsubstituted amino group or an etherified or non-etherified oxy or thio group, for example the $NH_2$ group, an amino group monosubstituted or disubstituted by $C_1$–$C_4$-alkyl radicals, a $C_1$–$C_4$-alkoxy group, a $C_1$–$C_4$-alkylmercapto group, arylamino, in particular phenylamino, or methyl-, methoxy-, chlorine- and, especially, sulfo-substituted phenylamino, phenoxy, mono- or di-sulfophenoxy and the like, and the corresponding chlorotriazinyl radicals.

The benzo rings drawn with broken lines in the formulae (11) and (15) denote a benzo ring possibly fused to the phenol radical written in full, so that the dyes selectively contain a phenol or naphthol radical.

Examples of the large number of anionic wool dyes which can be used in the process according to the invention are:

(a) triphenylmethane dyes, for example dyes of the formulae

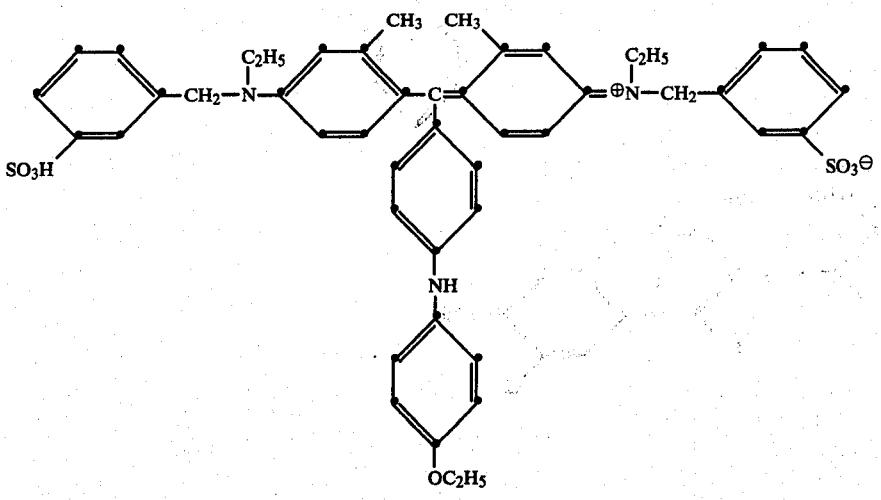

(23)

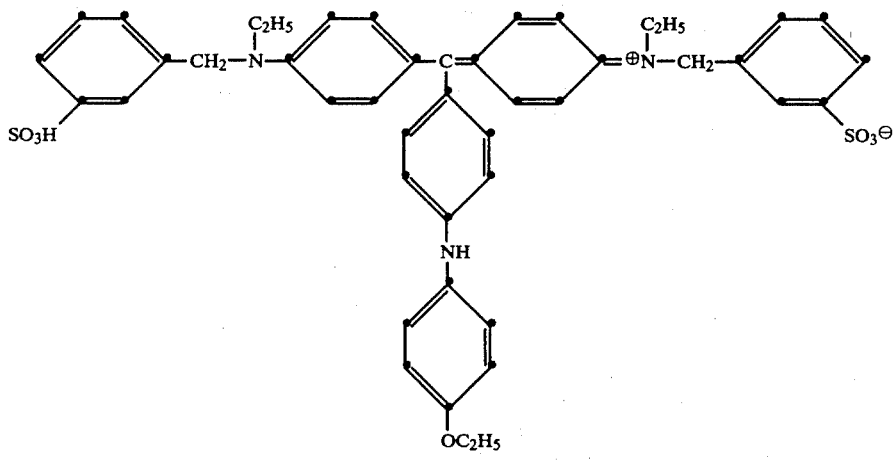
(24)
(b) monoazo and disazo dyes, for example those of the formulae
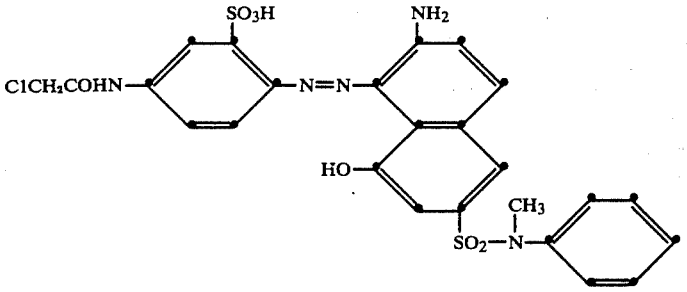
(25)
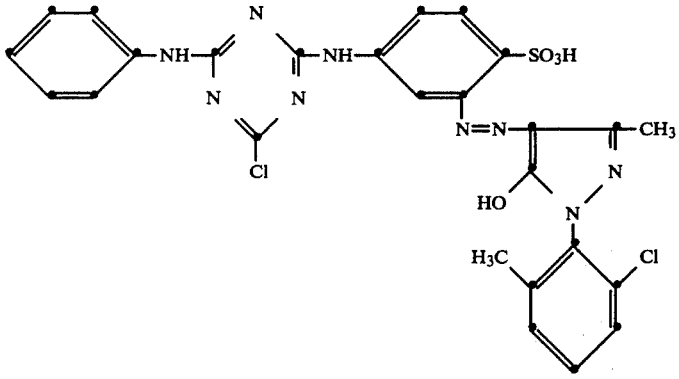
(26)
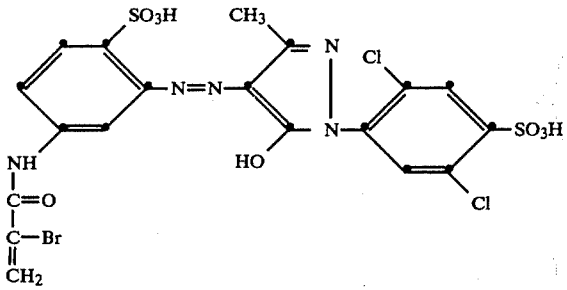
(27)

(28)
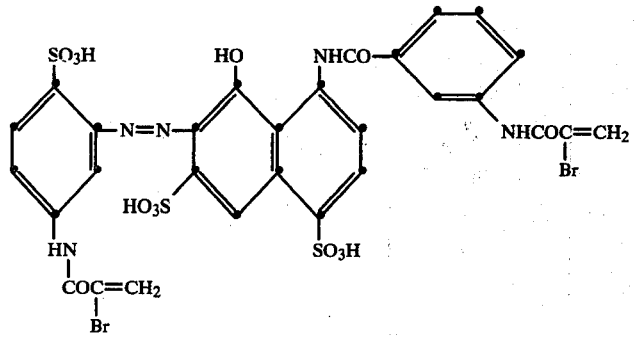
(29)
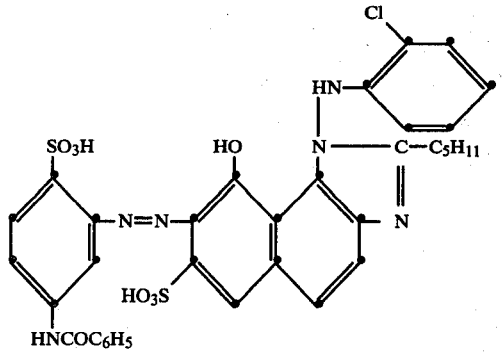
(30)
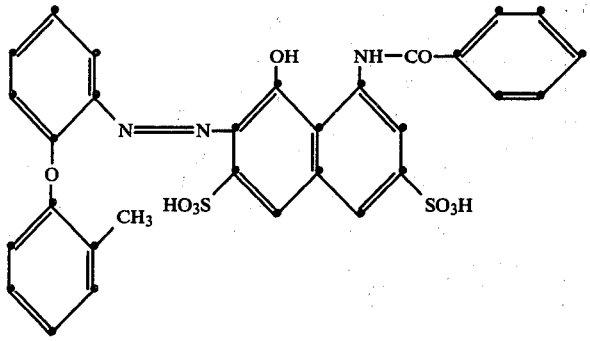
(31)
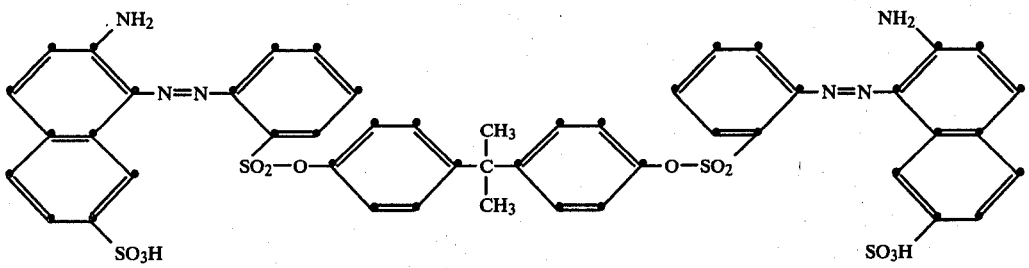
(32)
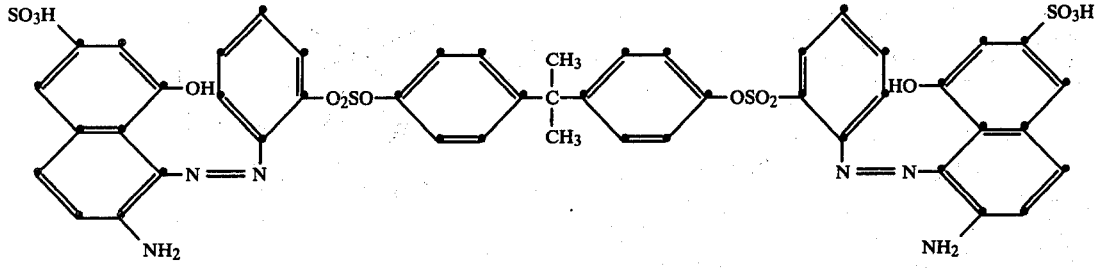
(c) 1:2 metal complex dyes, for example the 1:2 chromium complex of the azo and of the azomethine dye of the formulae

(33)
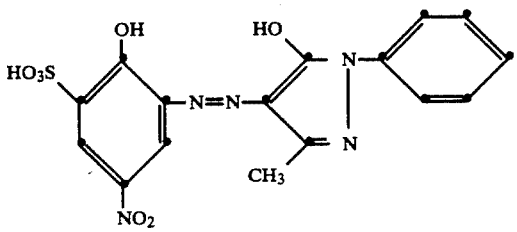
+
(34)
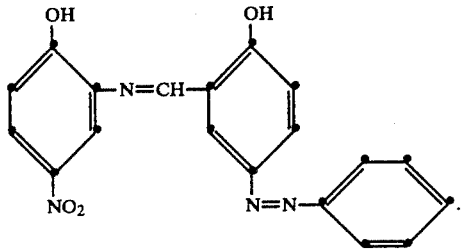
(37)
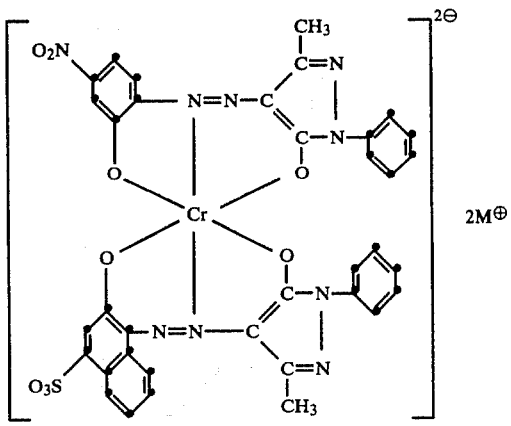
(d) 1:2 metal complex dyes, for example dyes of the formulae
(35)
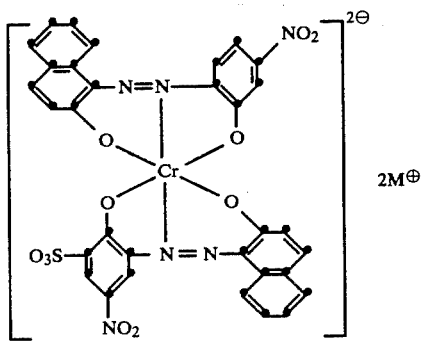
(38)
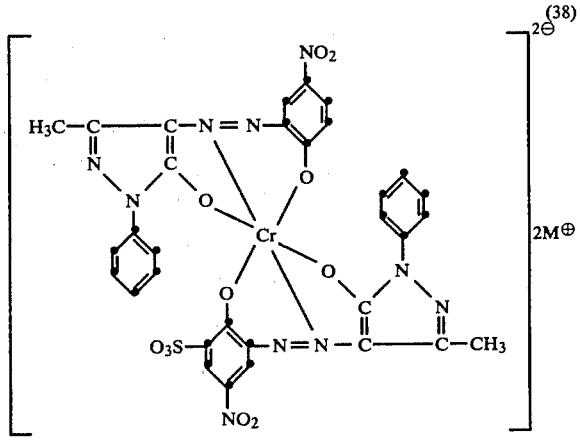
(36)
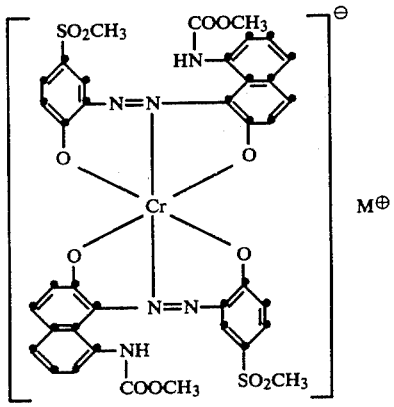
(39)
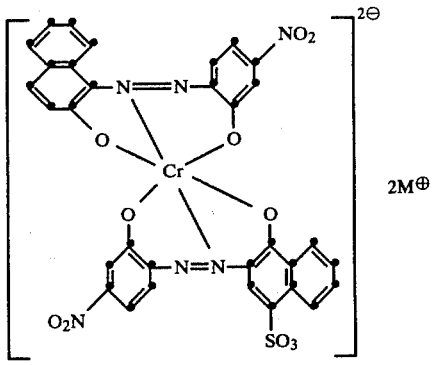
the 1:2 chromium complexes of the azo dyes of the formulae

(40)
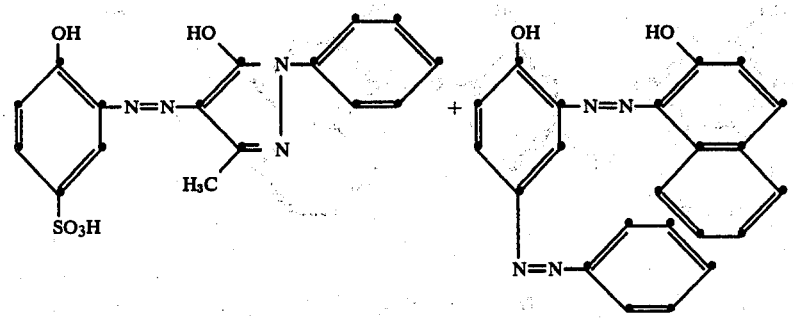
(41)
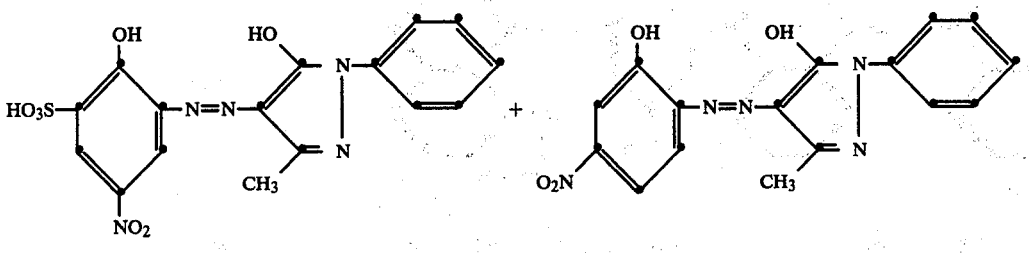
(42)
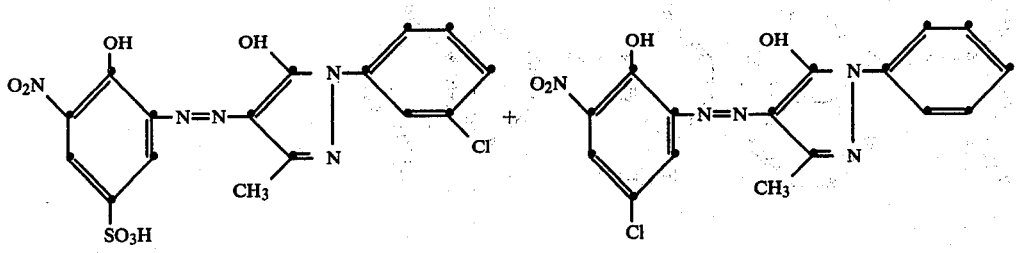
(43)
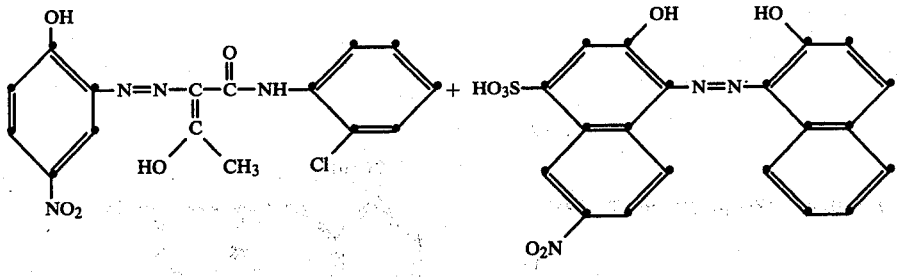
(44)
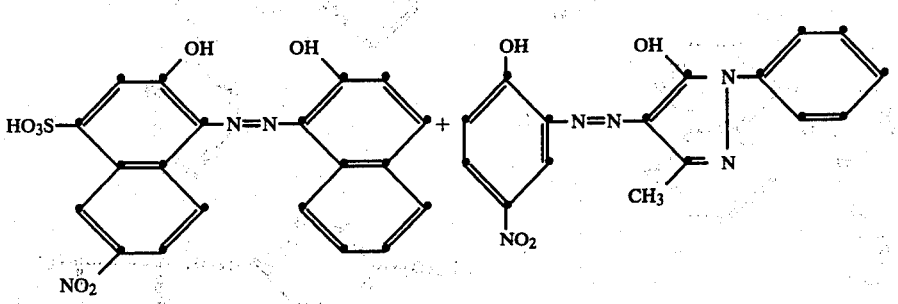
(45)
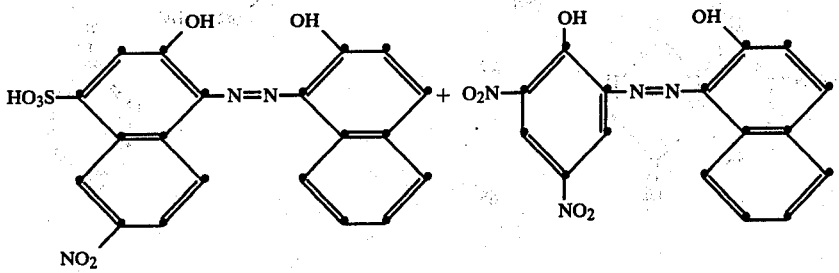

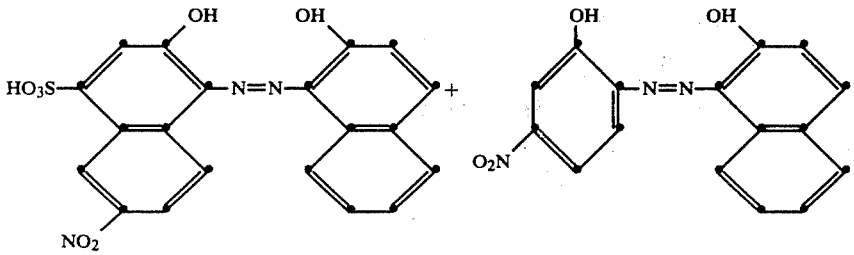
(46)
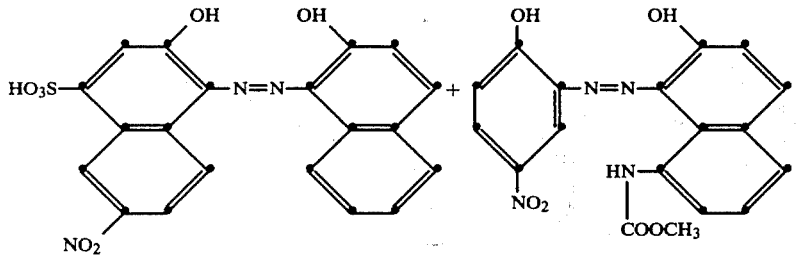
(47)
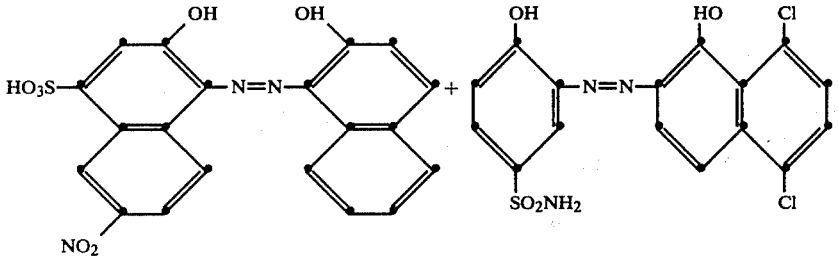
(48)
the symmetrical 1:2 chromium complexes of the azo dyes of the formulae
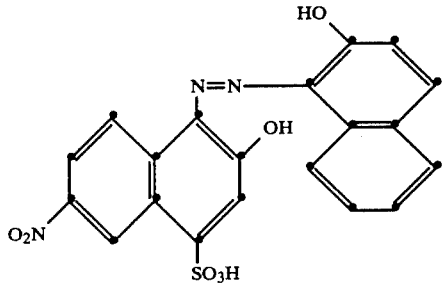
(49)
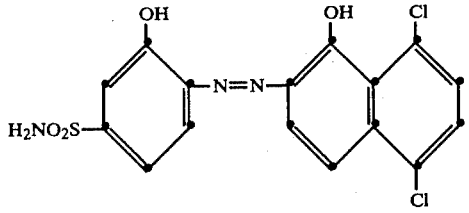
(50)
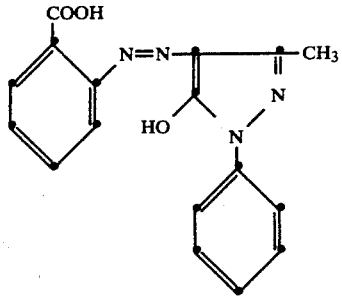
(51)
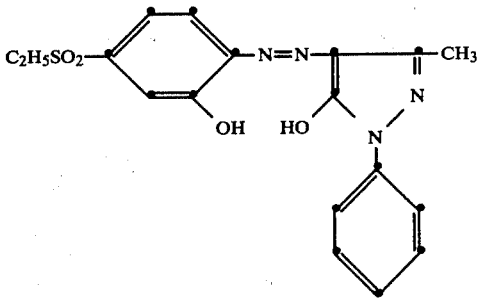
(52)

(53)
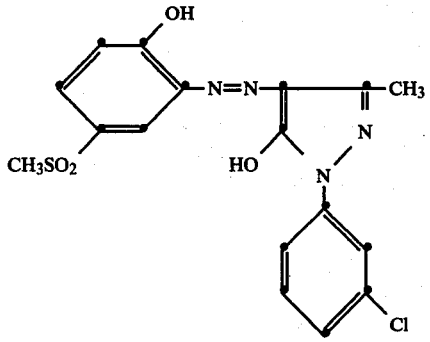
(54)
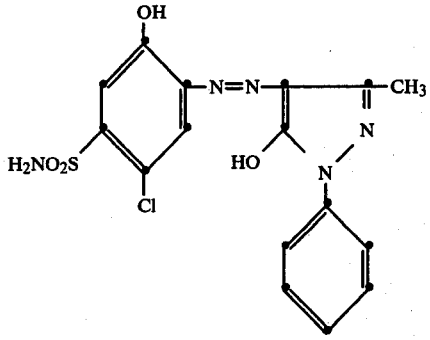
the symmetrical 1:2 cobalt complexes of the azo dyes of the formulae
(55)
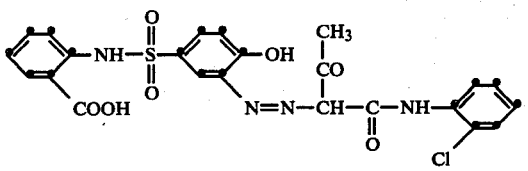
(56)
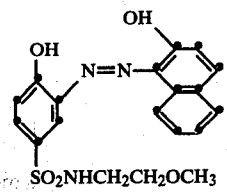
(57)
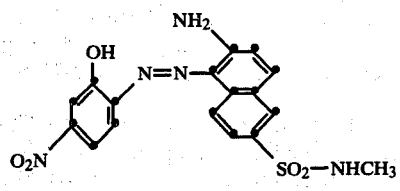
the 1:2 chromium complexes of the mixture of the azo dyes of the formulae
(58)
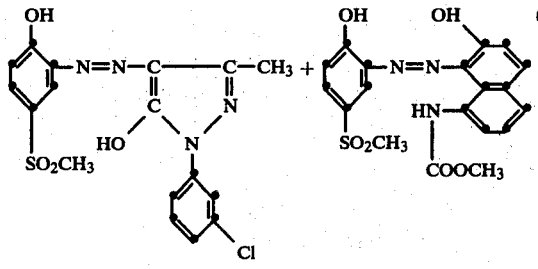
(e) anthraquinone dyes, for example those of the formulae
(59)
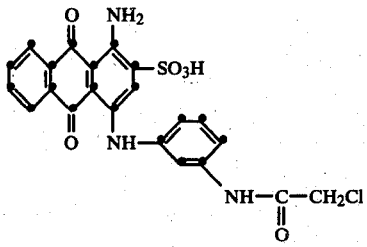
(60)
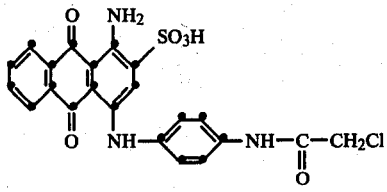
(61)
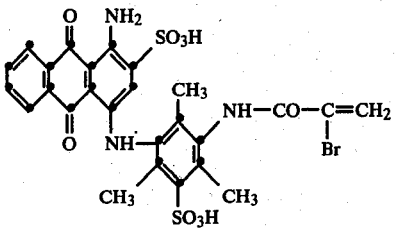
(62)
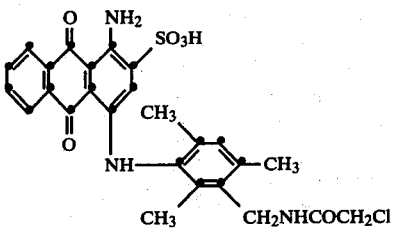
(63)
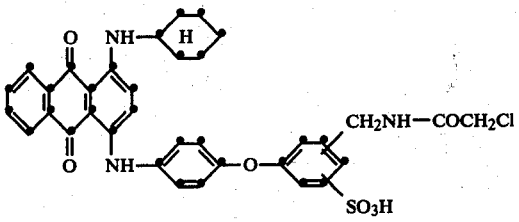
(64)
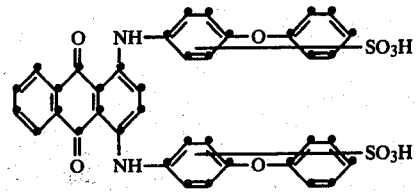

(65)

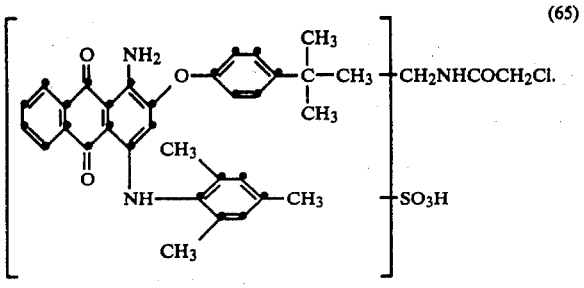

Sulfo-containing dyes used in the process according to the invention are either in the form of their free sulfonic acid or, preferably, in the form of its salts.

Examples of suitable salts are the alkali metal, alkaline earth metal or ammonium salts, or the salts of an organic amine. Specific examples are the salts of sodium, lithium, potassium or ammonium or of triethanolamine.

M⊕ in the formulae (35) to (39) shown above is the ion of an alkali metal, alkaline earth metal or ammonium, for example the sodium ion, potassium ion, lithium ion or ammonium ion.

If mixtures of dyes are used in the process according to the invention, they can be prepared by mixing the individual dyes. This mixing is effected, for example, in suitable mills, for example ball mills or pin mills, and in kneaders or mixers.

The mixtures of dyes can also be prepared by spray-drying aqueous dye mixtures.

The process according to the invention preferably uses dyes of the formulae (62) to (65) and mixtures of dyes of the formulae (24)+(39), (25)+(42), (26)+(27), (31)+(38), (40)+(44), (41)+(54), (32)+(37)+(56), (35)+(39)+(53)+(57), (36)+(51)+(53), (43)+(45)+(46)+(47)+(48)+(49) and (51)+(55). The individual dyes and the mixtures of these dyes are distinguished by excellent compatibility, which means that almost all shades for natural polyamide material can be provided.

Suitable radicals R, R′ and R″ in the formulae (1), (2) and (3) are independently of one another alkyl or alkenyl radicals having 12 to 22, preferably 16 to 22, carbon atoms. Specific examples are the n-dodecyl, myristyl, n-hexadecyl, n-heptadecyl, n-octadecyl, arachidyl, behenyl, dodecenyl, hexadecenyl, oleyl and octadecenyl radical.

A suitable radical M in formula (1) is hydrogen, an alkali metal, for example sodium or potassium, or, in particular, ammonium.

The radical Q and the anion $A^-$ in formula (2) are derived from quaternising agents, Q being a substituted or unsubstituted alkyl radical. Examples of suitable such quaternising agents are chloroacetamide, ethyl bromide, ethylenechlorohydrin, ethylenebromohydrin, epichlorohydrin, epibromohydrin and, in particular, dimethyl sulfate.

The process according to the invention preferably uses a mixture of dyeing assistants which contains 5 to 70 parts of the compound of the formula (1), 15 to 60 parts of the compound of the formula (2) and 5 to 60 parts of the compound of the formula (3), relative to 100 parts of the mixture of dyeing assistants.

In a preferable version of the process, the mixture of dyeing assistants used, in addition to compounds of the formulae (1), (2) and (3), also contains an adduct of 60 to 100 parts of ethylene oxide onto one part of a $C_{15-20}$-alkenyl alcohol. Specific examples of a $C_{15-20}$-alkenyl alcohol are hexadecenyl, oleyl and octadecenyl alcohol.

The amounts in which the mixture of dyeing assistants, which contains compounds of the formulae (1), (2) and (3) and, if desired, also the above adduct of ethylene oxide onto a $C_{15-20}$-alkenyl alcohol, are added to the dyebath vary between 0.5 and 2 percent by weight relative to the fibre material to be dyed. The amount preferably used is 1 percent by weight of the mixture of dyeing assistants relative to the fibre material.

The dyebaths can contain as a further additive mineral acids, such as sulfuric acid or phosphoric acid, and organic acids, advantageously lower aliphatic carboxylic acids, such as formic, acetic or oxalic acid. The acids are mainly used to set the pH of liquors used according to the invention.

The dyeing liquor can also contain salts, in particular ammonium or alkali metal salts, for example ammonium sulfate, ammonium or sodium acetate, or, preferably, sodium sulfate. It is preferable to use 0.1 to 10 percent by weight of ammonium sulfate or an alkali metal sulfate, relative to the fibre material.

The dyebaths, in addition to the dye and the said mixture of dyeing assistants, can also contain further customary additives, for example wool-protecting or wetting agents, or defoamers.

The liquor ratio can be chosen within a wide range, namely from 5:1 to 40:1, preferably 8:1 to 25:1.

Dyeing takes place from an aqueous liquor by the exhaust method, for example at temperatures between 95° and 105° C., preferably between 98° and 103° C.

The length of a dyeing is as a rule 10 to 50 minutes.

The process according to the invention requires no special equipment. It is possible to use the conventional dyeing apparatus and machines, for example for loose stock, tops, hanks, wound packages, piece goods and carpets.

The mixture of dyeing assistants is advantageously admixed with the aqueous liquor containing the dye, and applied at the same time as the dye. It is also possible to treat the goods first with the mixture of dyeing assistants and then to dye in the same bath after adding the dye. The fibre material is preferably put into a liquor which contains acid and the mixture of dyeing assistants and has a temperature of 30° to 70° C. The dye or mixture of dyes is then added, and the temperature of the dyebath is raised at a rate of 0.75° to 3° C. per minute, if appropriate with a temperature stop during the heating-up, and dyeing takes place within the specified temperature range, from 95° to 105° C., preferably for 10 to 50 minutes. At the end, the bath is cooled down, and the dyed material is, as customary, rinsed and dried.

The natural polyamide fibre material which can be dyed according to the invention is in particular wool but also wool/nylon, wool/polyester, wool/cellulose or wool/polyacrylonitrile blends and silk. The fibre material can be dyed at various stages in processing, for example as loose material, tops, yarn and piece goods or as carpet.

Compared with the known methods for fibre material made of natural polyamides, the process according to the invention, in addition to those already mentioned, also has the following advantages. The material thus dyed under uniform dyeing conditions is distinguished in the further processing, for example spinning, by uniform properties. The dyeings obtained are further distinguished by good all-around fastness properties, in particular good light and wet fastness properties, and they are dyed non-skittery and level regardless of the hue chosen and even regardless of the chosen mixture of various types of dye. A further significant advantage is that the dyes are virtually completely absorbed. On completion of dyeing the dyebaths are completely, or almost completely, exhausted, thereby enabling the heated aqueous (liquor to be used again and again, which practice consumes less energy.

German Offenlegungsschrift No. 2,834,686 describes a similar method of dyeing fibre material made of or containing wool. Compared with the dyeings of this known method, the dyeings obtained in the process according to the invention have superior levelness.

The invention also relates to the mixture of dyeing assistants which contains an anionic compound of the formula

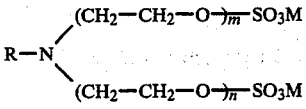

(1)

in which R is an alkyl or alkenyl radical having 12 to 22 carbon atoms, M is hydrogen, an alkali metal or ammonium, and m and n are integers such that the sum of m and n is 2 to 14, a quaternary compound of the formula

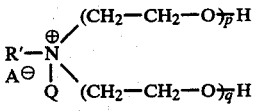

(2)

in which R', independently of R, is what R has been defined as, A is an anion, Q is a substituted or unsubstituted alkyl radical, and p and q are integers such that the sum of p and q is 20 to 50, and a non-ionic compound of the formula

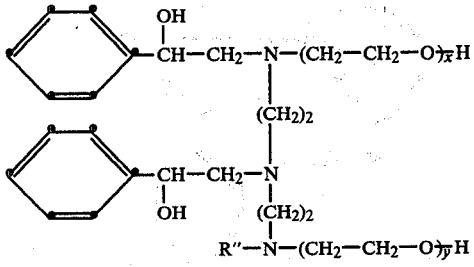

(3)

in which R'', independently of R, is what R has been defined as, and x and y are integers such that the sum of x and y is 80 to 140.

The mixture of dyeing assistants preferably contains 5 to 70 parts of the compound of the formula (1), 15 to 60 parts of the compound of the formula (2) and 5 to 60 parts of the compound of the formula (3) relative to 100 parts of the mixture of dyeing assistants.

In compounds of the formulae (1), (2) and (3), R, R' and R'' are as defined above. R, R' and R'' in the formulae (1), (2) and (3) preferably are independently of one another an alkyl or alkenyl radical having 16 to 22 carbon atoms.

The mixture of dyeing assistants, in addition to compounds of the formulae (1), (2) and (3), preferably also contains an adduct of 60 to 100 parts of ethylene oxide on a $C_{15-20}$-alkenyl alcohol.

The compounds of the formulae (1), (2) and (3) are known.

Compounds of the formula (1) can be prepared by addition of 2 to 14 mols of ethylene oxide onto aliphatic amines which have an alkyl or alkenyl radical having 12 to 22 carbon atoms, and converting the adduct into the acid ester and the latter, if desired, into its alkali metal or ammonium salts. Compounds of the formula (2) are prepared by addition of, for example, 20 to 50 mols of ethylene oxide onto aliphatic amines which have an alkyl or alkenyl radical having 12 to 22 carbon atoms, and reacting the adduct with one of the abovementioned quaternising agents to give the compound of the formula (2).

Compounds of the formula (3) are prepared by the addition of 80 to 140 mols of ethylene oxide onto a compound of the formula

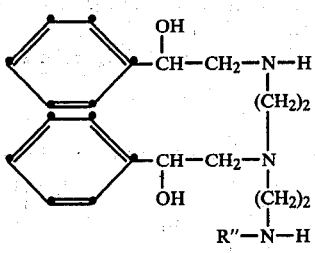

(66)

in which R'' is as defined under formula (3).

Amines required as starting materials in the preparation of compounds of the formulae (1) and (2) can have saturated or unsaturated, branched or unbranched hydrocarbon radicals having 12 to 22, preferably 16 to 22, carbon atoms. The amines can be single compounds or be in the form of mixtures. The amine mixtures used are preferably those formed in the conversion of natural fats or oils, for example tallow fat or soya bean or coconut oil, into the corresponding amines. Specific examples of amines are dodecylamine, hexadecylamine, octadecylamine, arachidylamine, behenylamine and octadecenylamine. Tallowamine is preferred. This is a mixture of 30% of hexadecylamine, 25% of octadecylamine and 45% of octadecylamine.

Not only the addition of ethylene oxide but also the esterification can be carried out according to methods known per se. The esterification can be performed with sulfuric acid or its functional derivatives, for example chlorosulfonic acid or, in particular, sulfamic acid.

The esterification is generally carried out by simply mixing the reactants while heating them, advantageously at a temperature between 50° and 100° C. The free acids can then be converted into the alkali metal or ammonium salts by adding in a conventional manner bases, for example ammonia or sodium or potassium hydroxide.

The examples which follow serve to illustrate the invention. In these examples, parts are parts by weight and percentages are percentages by weight. The temperatures are given in degrees centrigrade. The parts by weight are related to the parts by volume as the gram relates to the cubic centimeter.

The mixture of dyeing assistants referred to as $A_1$, in the examples, which follow, has the following composition:

12.6 parts of the anionic compound of the formula

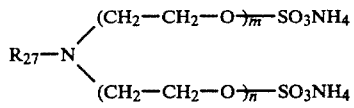

(67)

$R_{27}$=hydrocarbon radical of tallowamine, m+n=8;

21.3 parts of the quaternary compound of the formula

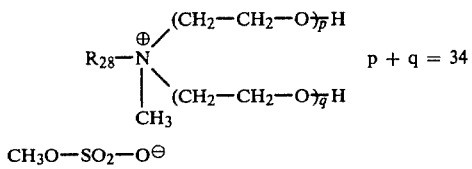

(68)

$R_{28}$=$C_{20-22}$ hydrocarbon radical;

7.7 parts of the reaction product between oleyl alcohol and 80 mols of ethylene oxide;

7.0 parts of the compound of the formula

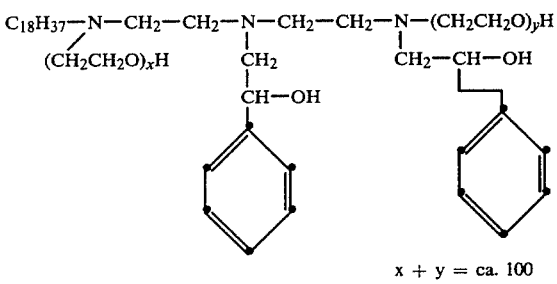

(69)

and 51.4 parts of water.

The mixture of dyeing assistants referred to as $A_2$ in the examples, which follow, has the following composition:

15.2 parts of the anionic compound of the formula (67), 21.3 parts of the quaternary compound of the formula (68), 7.7 parts of the reaction product between oleyl alcohol and 80 parts of ethylene oxide, 12.6 parts of the compound of the formula (69) and 43.2 parts of water.

The mixture of dyeing assistants referred to as $A_3$ in the examples, which follow, has the following composition:

12.6 parts of the anionic compound of the formula (67), 21.3 parts of the quaternary compound of the formula (68), 7.7 parts of the reaction product between oleyl alcohol and 80 mols of ethylene oxide, 10.0 parts of the compound of the formula (69) and 48.4 parts of water.

The mixture of dyeing assistants referred to as $A_4$ in the examples, which follow, has the following composition:

15.2 parts of the anionic compound of the formula (67), 21.3 parts of the quaternary compound of the formula (68), 7.7 parts of the reaction product between oleyl alcohol and 80 mols of ethylene oxide, 31 parts of the compound of the formula (69) and 24.8 parts of water.

EXAMPLE 1

3 kg of wool yarn are put at 40° C. in a hank-dyeing apparatus into a dyeing liquor which contains 81 liters of water, 300 g of calcined sodium sulfate, 45 g of 60% acetic acid, 81 g of sodium acetate and 30 g of dyeing assistant mixture $A_1$. 1.7 g of the 1:2 cobalt complex of the dye of the formula

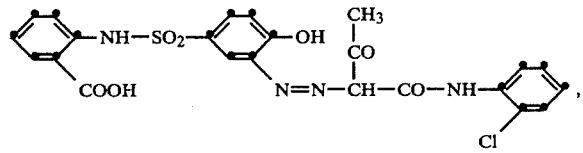

0.85 g of the 1:2 chromium complex of the dye of the formula

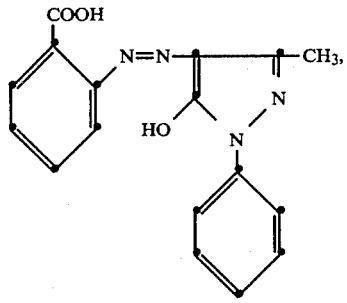

1.3 g of the 1:2 chromium complex of the dye of the formula

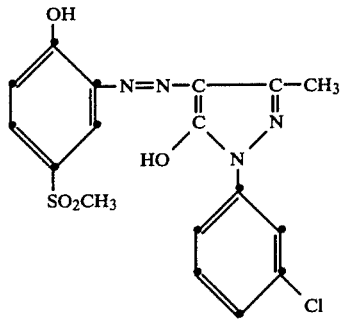

0.4 g of the 1:2 chromium complex of the dye of the formula

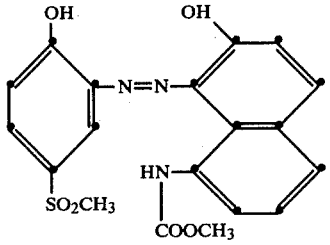

and 3.8 g of the 1:2 chromium complex containing one dye molecule each of the formulae

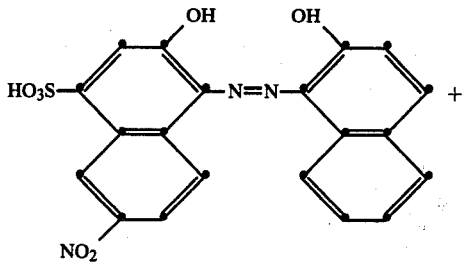

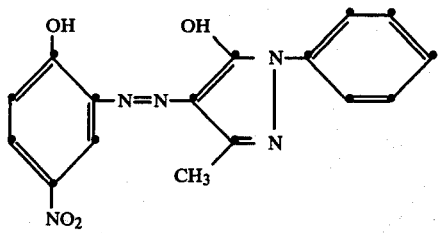

are added after 10 minutes. While the circulating liquor changes direction of flow at set intervals, the dyeing liquor is heated in the course of 50 minutes to 98° C., and dyeing is carried out at this temperature for 30 minutes. The pH at the start is 4.7 and at the end 4.9. The dyebath is then cooled down, and the wool yarn is rinsed and dried. This gives a non-skittery and level beige dyeing of the wool yarn. The degree of exhaustion is 98%.

EXAMPLE 2

16 kg of chlorinated wool yarn are put at 40° C. in a hank-dyeing apparatus into a dyeing liquor which contains 432 liters of water, 320 g of calcined sodium sulfate, 192 g of 60% acetic acid, 432 g of sodium acetate and 160 g of dyeing assistant mixture $A_1$. 270 g of the dye of the formula

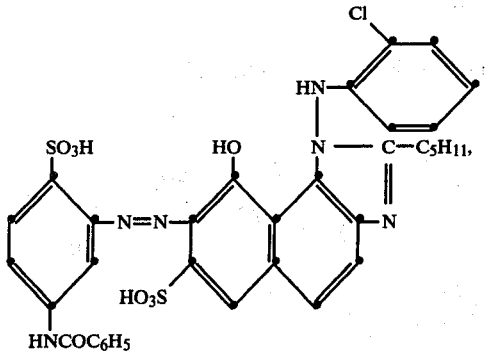

39.5 g of the dye of the formula

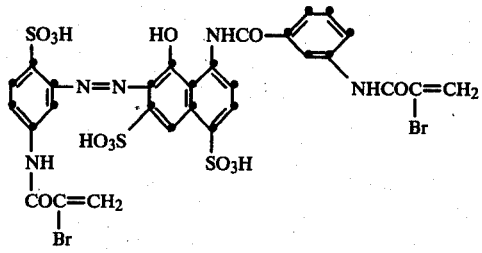

and 90 g of the dye of the formula

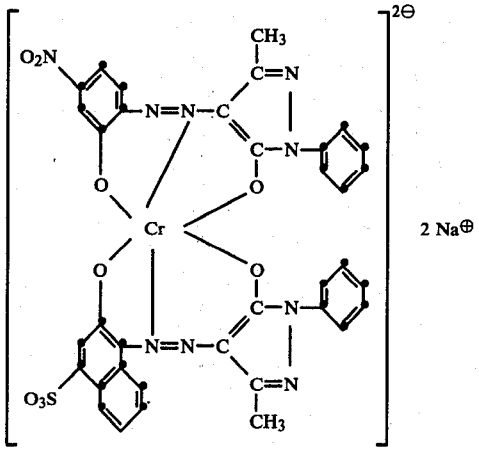

are added after 10 minutes. The pH at the start is 4.8 and at the end 5.0. While the circulating liquor changes direction of flow at set intervals, the dyeing liquor is heated in the course of 50 minutes to 98° C., and dyeing is carried out at this temperature for 40 minutes. The dyebath is then cooled down, and the wool yarn is rinsed and dried. This gives a non-skittery and level red dyeing of the wool yarn. The degree of exhaustion is 96%.

EXAMPLE 3

16 kg of Hercosett-finished superwash wool yarn are put at 40° C. in a hank-dyeing apparatus into a dyeing liquor which contains 432 liters of water, 1,600 g of calcined sodium sulfate, 192 g of 60% acetic acid, 432 g of sodium acetate and 160 g of dyeing assistant mixture $A_2$. 56 g of the dye of the formula

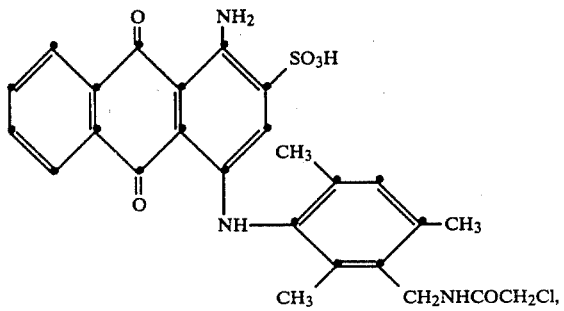

6 g of the dye of the formula

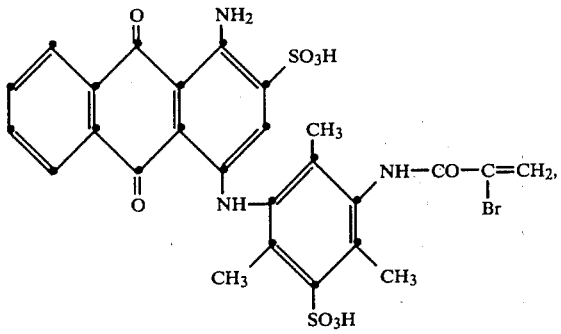

64 g of the dye of the formula

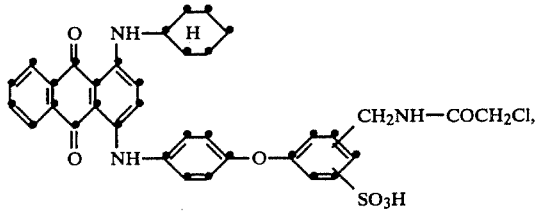

1.3 g of the dye of the formula

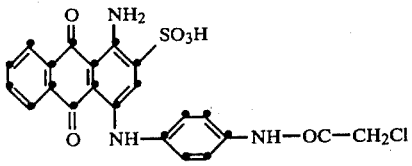

and 27.7 g of the dye of the formula

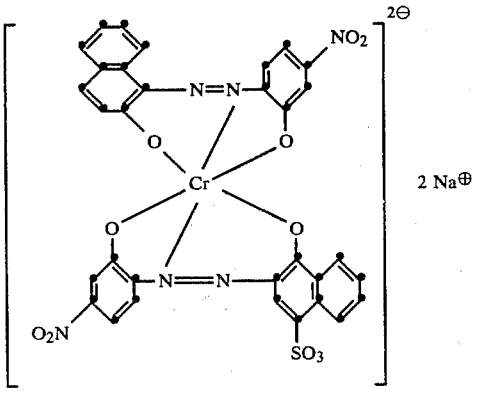

are added after 10 minutes. The pH at the start is 4.9 and at the end 5.1. While the circulating liquor changes direction of flow at set intervals, the dyeing liquor is heated in the course of 50 minutes to 98° C., and dyeing is carried out at this temperature for 30 minutes. The dyebath is then cooled down, and the wool yarn is rinsed and dried. This gives a non-skittery and level fast blue dyeing of the wool yarn. The degree of exhaustion is 98%.

EXAMPLE 4

5 kg of wool tops are wetted at 50° C. in 75 liters of water in a pack-dyeing apparatus. 75 g of 80% acetic acid and 50 g of dyeing assistant mixture $A_1$ are then added. 96 g of the dye of the formula

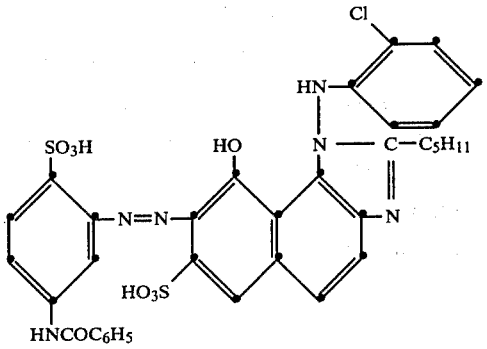

and 14 g of the dye of the formula

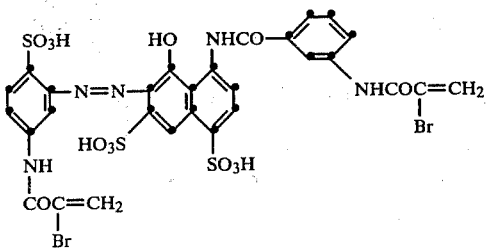

are added after 10 minutes. The dyeing liquor is heated in the course of 50 minutes to 98° C., and dyeing is carried out at this temperature for 30 minutes. The wool is then rinsed and dried. This gives a very level wine-red dyeing of the wool tops. The pH at the start is 4.8 and at the end of the dyeing 5.1. The degree of exhaustion is 98%.

EXAMPLE 5

In a cheese-dyeing apparatus, a 1 kg spring is loaded with wool yarn and wetted at 50° C. in 20 liters of water. 50 g of calcined sodium sulfate, 10 g of 80% acetic acid, 20 g of sodium acetate and 10 g of the dyeing assistant mixture $A_1$ are then added. 8.2 g of the dye of the formula

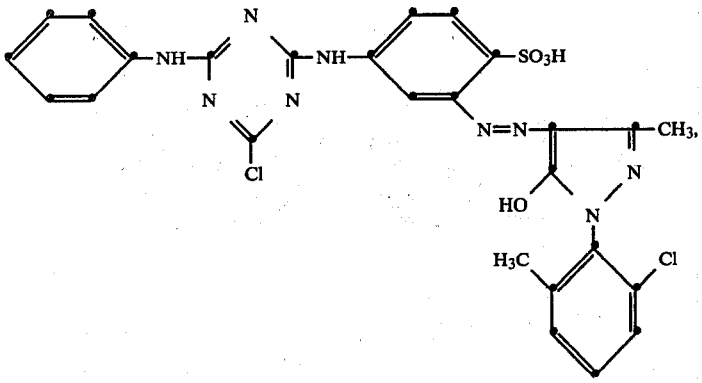

1.1 g of the dye of the formula

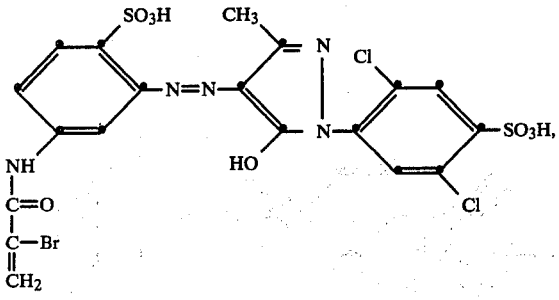

3 g of the dye of the formula

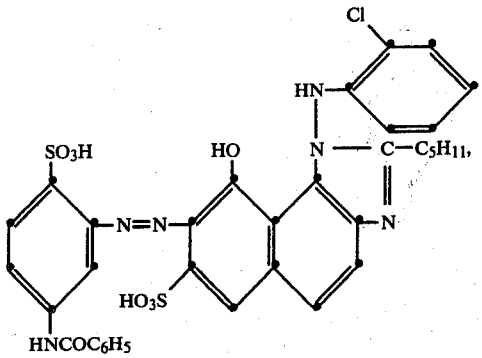

0.5 g of the dye of the formula

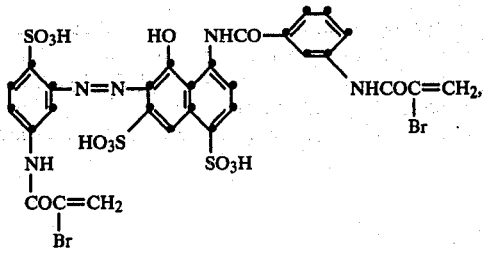

0.2 g of the dye of the formula

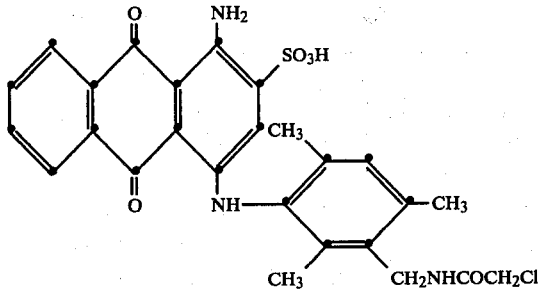

and 0.04 g of the dye of the formula

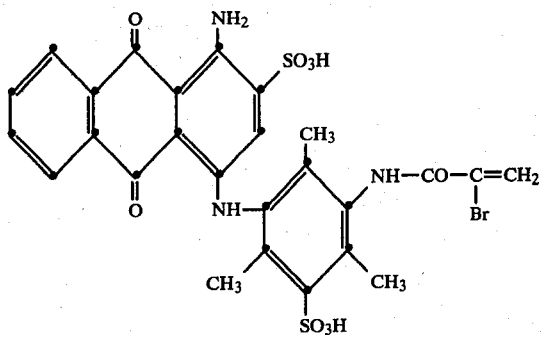

are added after 10 minutes. The temperature is raised in the course of 50 minutes to 98° C., and dyeing is carried out at this temperature for 30 minutes. The cheese is then rinsed, hydroextracted and dried. This gives a very non-skittery and level fast orange dyeing of the wool yarn. The pH during the dyeing is between 5.0 and 5.1. The degree of exhaustion is 99%.

EXAMPLE 6
16 kg of wool yarn are put at 40° C. in a hank-dyeing apparatus into a dyeing liquor which contains 432 liters of water, 640 g of calcined sodium sulfate, 192 g of 60% acetic acid, 432 g of sodium acetate and 160 g of dyeing assistant mixture $A_1$. 123 g of the dye of the formula
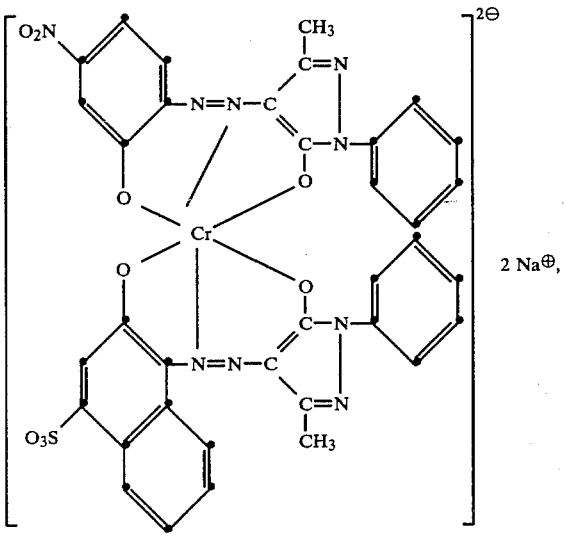
52 g of the dye of the formula
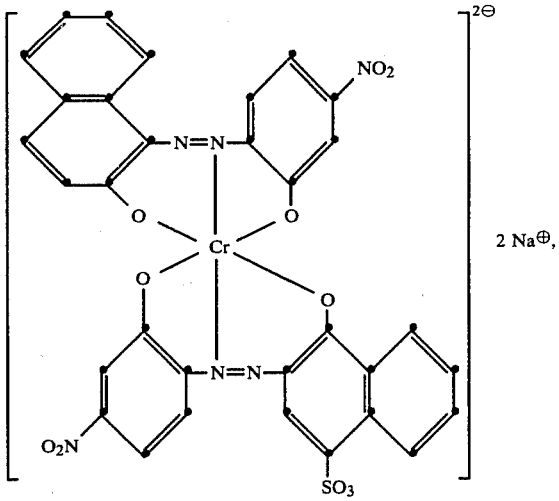
8.0 g of the dye of the formula
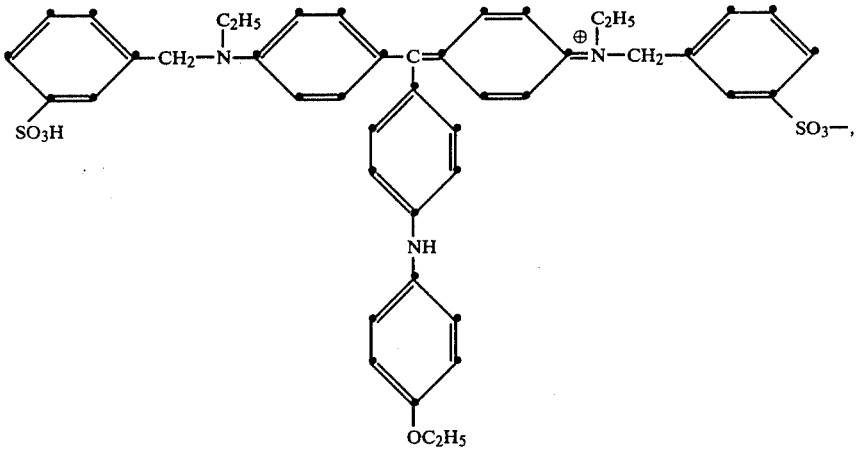
1.5 g of the dye of the formula

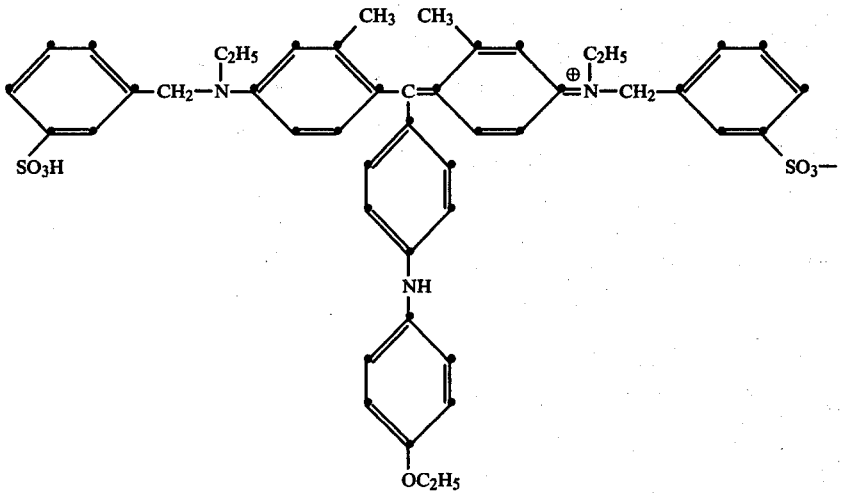

and 1.8 g of the dye of the formula

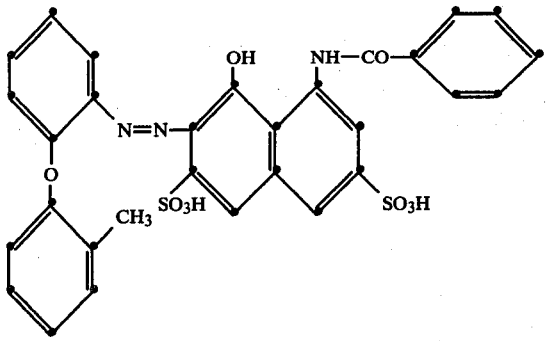

are added after 10 minutes. While the circulating liquor changes direction of flow at set intervals, the dyeing liquor is heated in the course of 50 minutes to 98° C., and dyeing is carried out at this temperature for 40 minutes. The dyebath is then cooled down, and the wool yarn is rinsed and dried. This gives a non-skittery and level violet dyeing of the wool yarn. The pH of the dyebath during the dyeing is between 4.8 and 4.9. The degree of exhaustion is 97%.

EXAMPLE 7

16 kg of wool yarn are put at 40° C. in a hank-dyeing apparatus into a dyeing liquor which contains 432 liters of water, 1,600 g of calcined sodium sulfate, 192 g of 60% acetic acid, 432 g of sodium acetate and 80 g of dyeing assistant mixture $A_1$. 0.4 g of the 1:2 cobalt complex of the dye of the formula

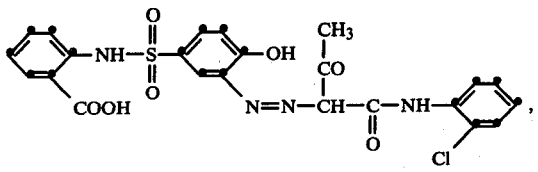

0.21 g of the 1:2 chromium complex of the dye of the formula

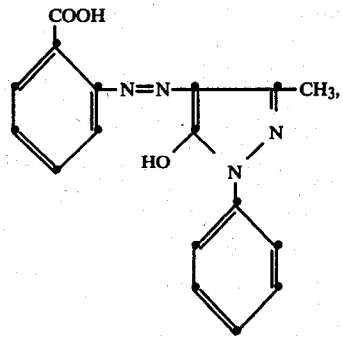

0.26 g of the 1:2 chromium complex of the dye of the formula

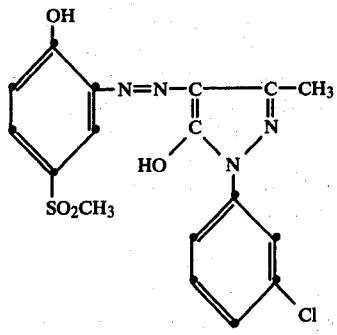

0.07 g of the 1:2 chromium complex of the dye of the formula

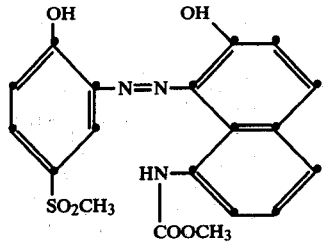

and 4.0 g of the 1:2 chromium complex containing one dye molecule each of the formulae

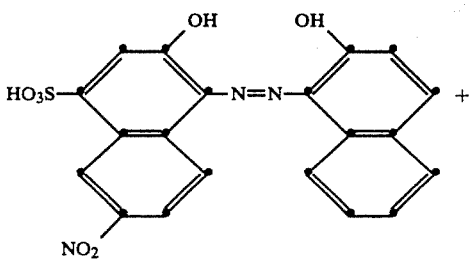

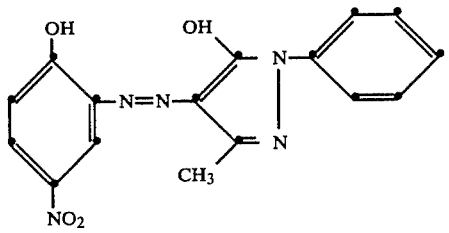

are added after 10 minutes. While the circulating liquor changes direction of flow at set intervals, the dyeing liquor is heated in the course of 50 minutes to 98° C., and dyeing is carried out at this temperature for 30 minutes. The dyebath is then cooled down, and the wool yarn is rinsed and dried. This gives a non-skittery and level pale beige dyeing of the wool yarn. The pH of the dyebath at the start is 4.6 and at the end 4.8. The degree of exhaustion is 99%.

EXAMPLE 8

On a winch, 10 kg of a wool fabric are wetted at 40° C. in 300 liters of water. 700 g of calcined sodium sulfate, 300 g of sodium acetate and 100 g of the dyeing assistant mixture $A_1$ are then added to the liquor, and the liquor is adjusted to pH 4.9 with 60% acetic acid. 1.5 g of the 1:2 cobalt complex of the dye of the formula

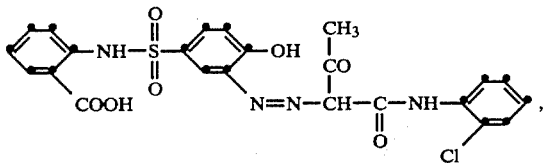

0.7 g of the 1:2 chromium complex of the dye of the formula

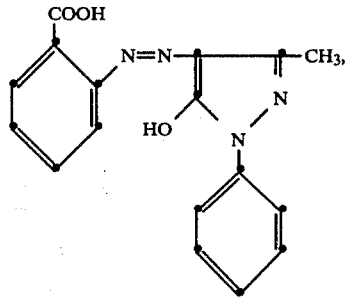

2 g of the dye of the formula

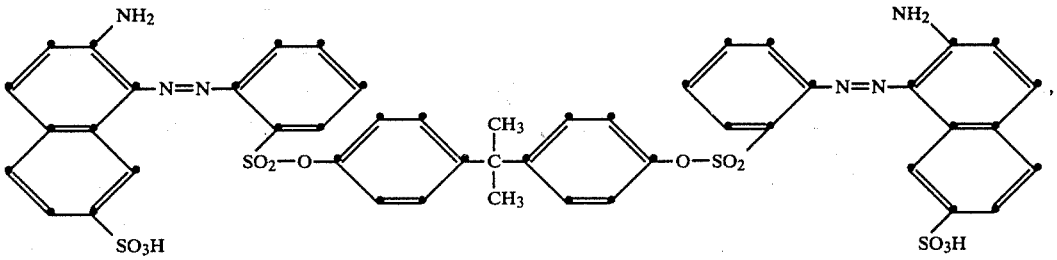

2.6 g of the dye of the formula

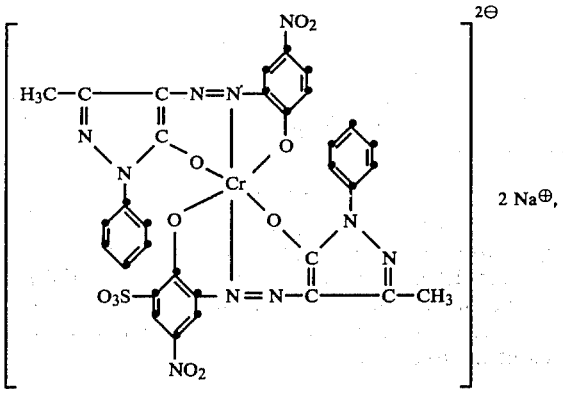

6.6 g of the dye of the formula

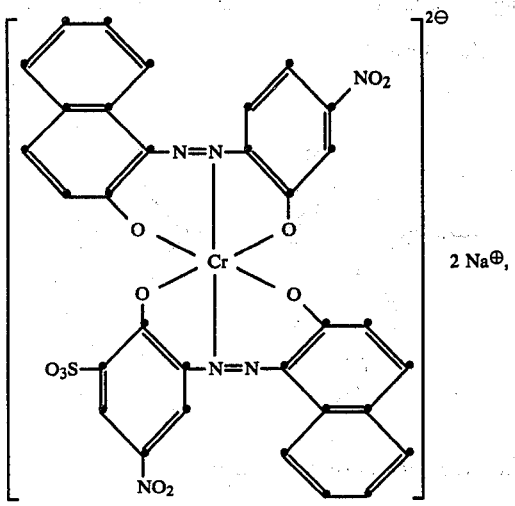

5.5 g of the 1:2 cobalt complex of the dye of the formula

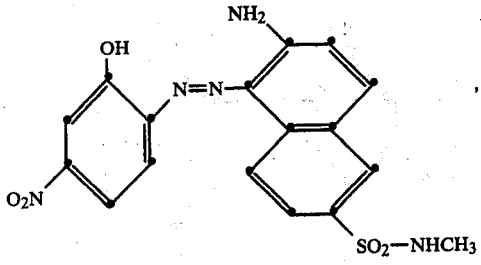

5.7 g of the dye of the formula

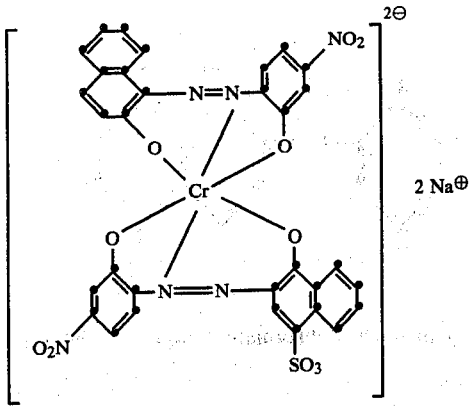

and 1.1 g of the 1:2 chromium complex of the dye of the formula

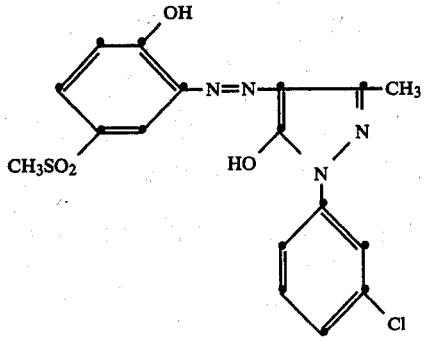

are added after 10 minutes. The dyeing liquor is heated in the course of 50 minutes to 98° C., and dyeing is carried out at this temperature for 30 minutes. The dyebath is then cooled down, and the wool yarn is rinsed and dried. This gives a non-skittery and level fast grey dyeing of the wool fabric. The pH of the dyebath at the start is 4.8 and at the end 5.0. The degree of exhaustion is 98%.

EXAMPLE 9

16 kg of wool yarn are put at 40° C. in a hank-dyeing apparatus into a dyeing liquor which contains 432 liters of water, 1,600 g of calcined sodium sulfate, 240 g of 60% acetic acid, 432 g of sodium acetate and 160 g of dyeing assistant mixture $A_1$. 19.5 g of the 1:2 cobalt complex of the dye of the formula

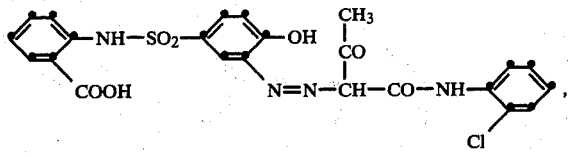

10.55 g of the 1:2 chromium complex of the dye of the formula

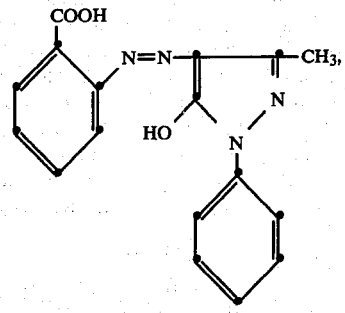

30.2 g of the 1:2 chromium complex of the dye of the formula

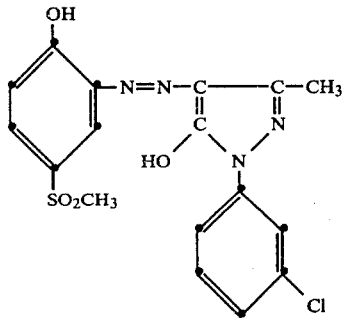

7.8 g of the 1:2 chromium complex of the dye of the formula

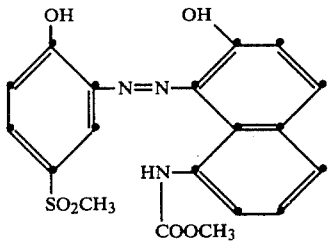

and 102 g of the 1:2 chromium complex containing one dye molecule each of the formulae

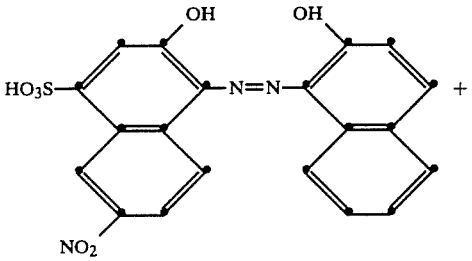

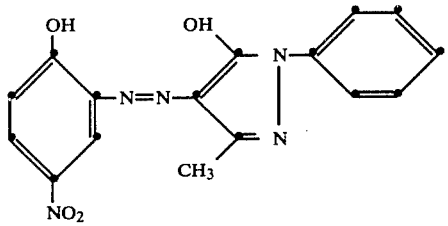

are added after 10 minutes. While the circulating liquor changes direction of flow at set intervals the temperature is raised in the course of 25 minutes to 70° C., maintained at 70° C. for 20 minutes, and then raised in the course of 20 minutes to 98° C., and dyeing is carried out at this temperature for 30 minutes. The dyebath is then cooled down, and the wool yarn is rinsed and dried. This gives a non-skittery and level brown dyeing of the wool yarn. The pH of the dyebath at the start is 4.7 and at the end 4.8. The degree of exhaustion is 98%.

EXAMPLE 10

In a pack-dyeing apparatus, 2 kg of loose Australian wool are wetted at 60° C. in 40 liters of water. 100 g of calcined sodium sulfate, 30 g of 80% acetic acid, 40 g of sodium acetate and 40 g of the dyeing assistant mixture $A_3$ are then added. 10 g of the 1:2 chromium mixed complex obtained by reacting the 1:1 chromium complex of the formula

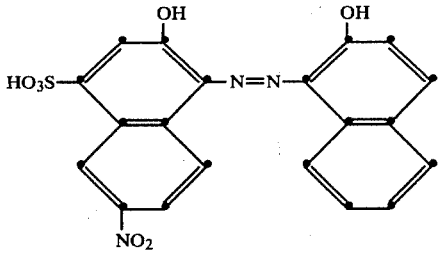

with the compounds of the formulae

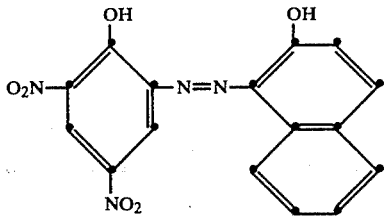

(a)

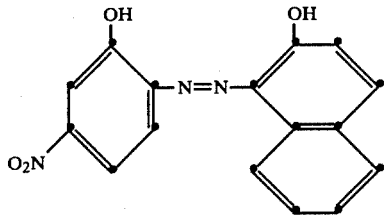

(b)

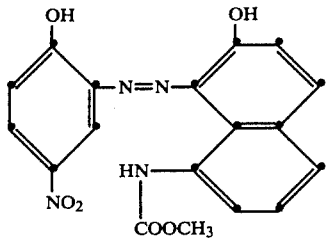

(c)

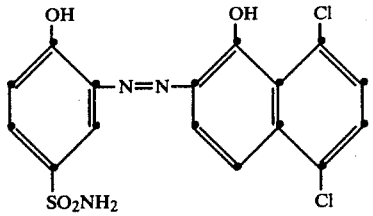

(d)

10.5 g of the 1:2 chromium complex of the dye of the formula

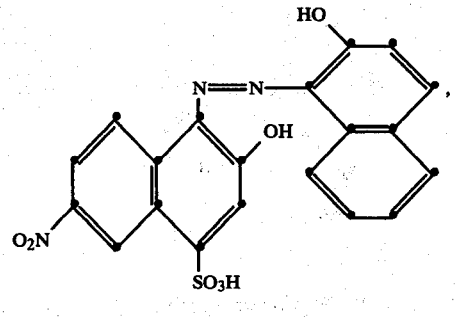

1.2 g of the 1:2 chromium complex containing in the molecule one dye each of the formulae

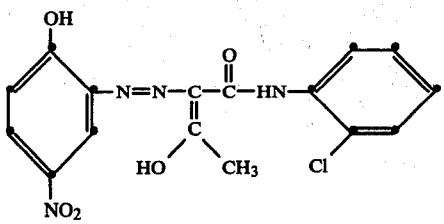

and

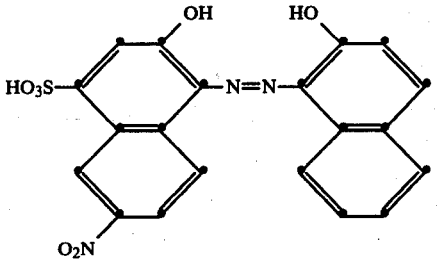

and 10.8 g of the dye of the formula

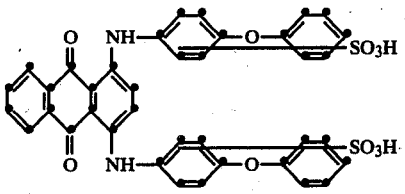

are added after 10 minutes. The dyeing liquor is heated in the course of 45 minutes to 103° C., and dyeing is caried out at this temperature for 25 minutes. When the dyeing liquor has cooled down, the wool is rinsed and dried. This gives a very non-skittery and level dark grey dyeing of the wool. The pH of the dyeing liquor is at the start 4.8 and at the end 5.0. The degree of exhaustion is 98%.

EXAMPLE 11

In a pack-dyeing apparatus, 2 kg of wool tops are wetted at 60° C. in 30 liters of water. 30 g of 80% acetic acid and 10 g of dyeing assistant mixture $A_4$ are then added. 13.5 g of the 1:2 chromium complex containing in the molecule one dye each of the formulae

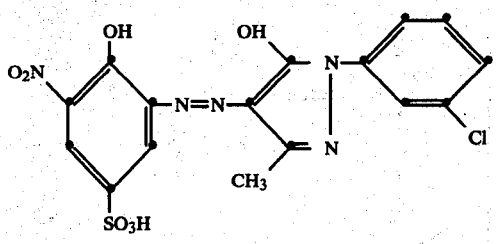

and

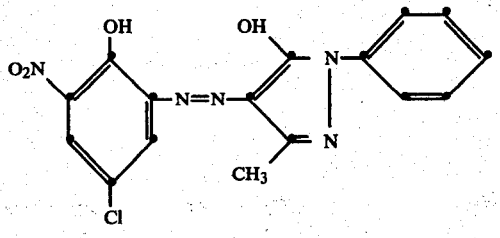

and 20 g of the dye of the formula

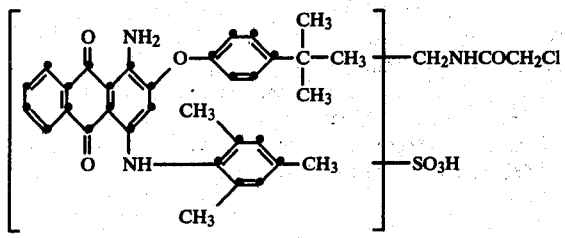

are added after 10 minutes. The dyeing liquor is heated in the course of 45 minutes to 103° C., and dyeing is carried out at this temperature for 30 minutes. When the liquor has cooled down, the wool tops are rinsed and dried. This gives a very non-skittery and level violet dyeing of the wool. The pH of the dyeing liquor is at the start 4.9 and at the end 5.1. The degree of exhaustion is 97%.

EXAMPLE 12

In a pack-dyeing apparatus, 150 kg of wool tops are wetted at 52° C. in 1,350 liters of water. 1,350 g of sodium acetate, 4,500 g of 60% acetic acid and 1,500 g of the dyeing assistant mixture $A_1$ are then added. 2,200 g of the dye of the formula

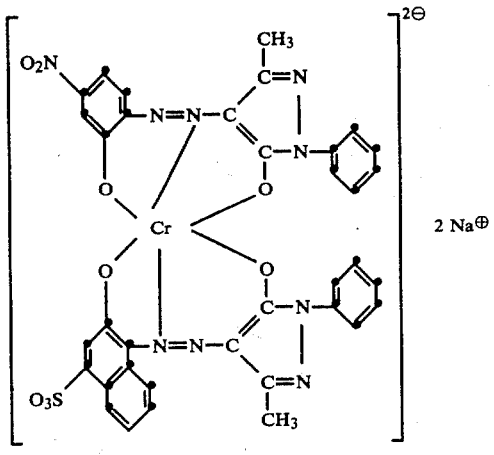

are added after 10 minutes. The dyeing liquor is heated in the course of 30 minutes to 97°, and dyeing is carried out at this temperature for 16 minutes. When the liquor is cooled down, the wool tops are rinsed and dried. This gives a very non-skittery and level red dyeing of the wool. The pH value of the dyebath is at the start 4.8 and at the end 4.9. The degree of exhaustion is 98%.

EXAMPLE 13

In a cheese-dyeing apparatus, a 3 kg spring is loaded with wool yarn and wetted at 50° C. in 24 liters of water. 24 g of sodium acetate, 60 g of 60% acetic acid, 177 g of calcined sodium sulfate and 30 g of the dyeing assistant mixture $A_2$ are then added. 30 g of the 1:2 chromium complex containing in the molecule one dye molecule each of the formulae -continued

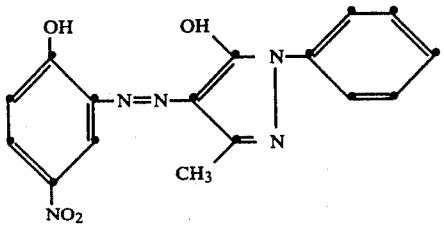

15 g of the 1:2 chromium complex of the azo dyes of the formulae

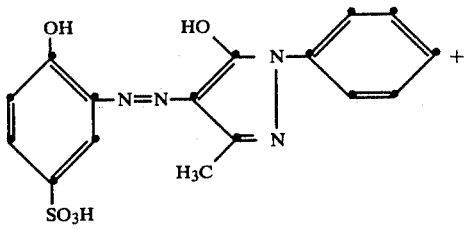

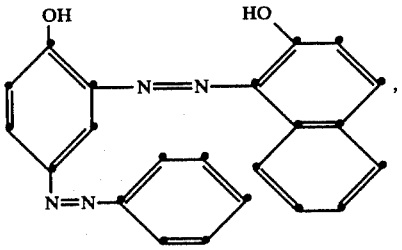

1 g of the dye of the formula

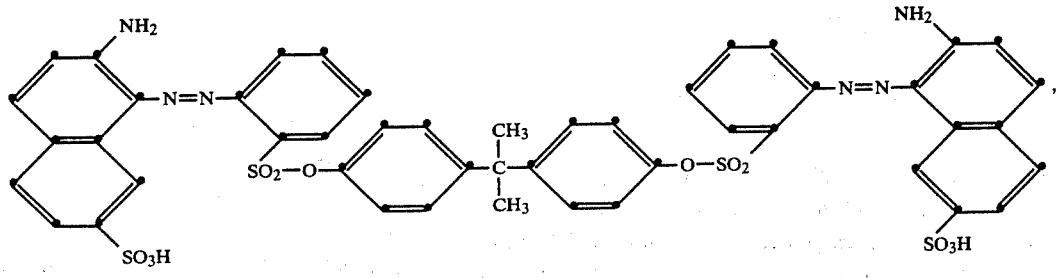

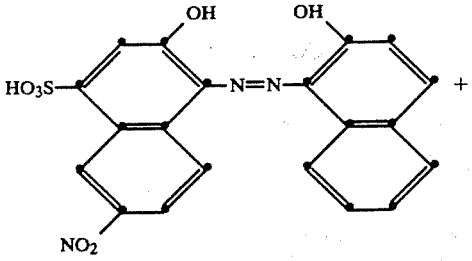

and 1.3 g of the dye of the formula

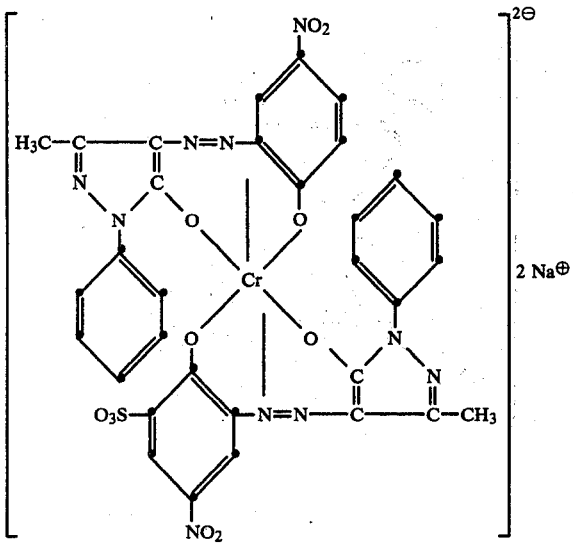

are added after 10 minutes. The temperature is raised in the course of 40 minutes to 104° C., and dyeing is carried out at this temperature for 20 minutes. The cheese is then rinsed, hydroextracted and dried. This gives a very non-skittery and level reddish brown dyeing of the wool yarn. The pH during the dyeing is between 4.8 and 5.0. The degree of exhaustion is 95%.

EXAMPLE 14

In a cheese-dyeing apparatus, springs are loaded with 271.2 kg of wool yarn and wetted at 50° C. in 2,000 liters of water. 2 kg of sodium acetate, 5.4 kg of 60% acetic acid, 13.6 kg of calcined sodium sulfate and 2.7 kg of the dyeing assistant mixture $A_1$ are then added. 44 g of the 1:2 chromium complex of the azo dyes of the formulae

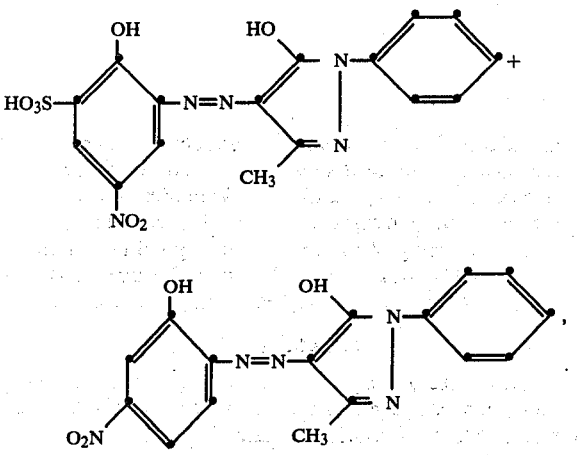

8.5 g of the 1:2 chromium complex of the dye of the formula

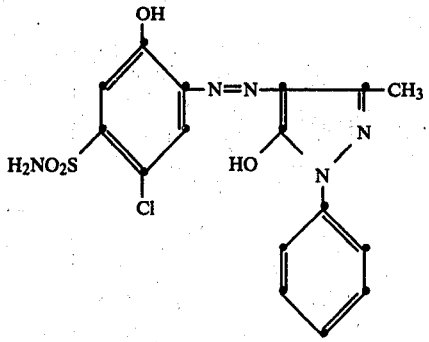

122 g of the dye of the formula

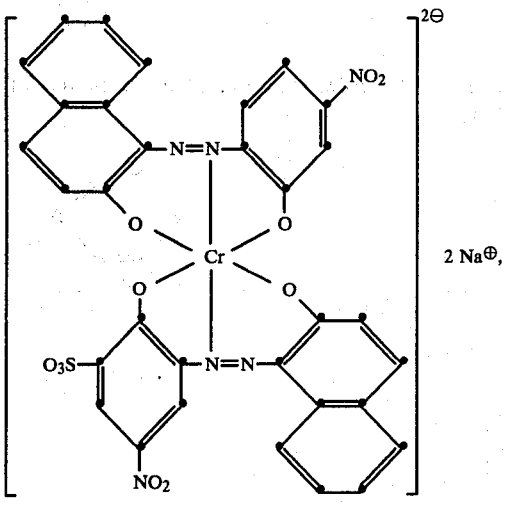

103 g of the 1:2 cobalt complex of the dye of the formula

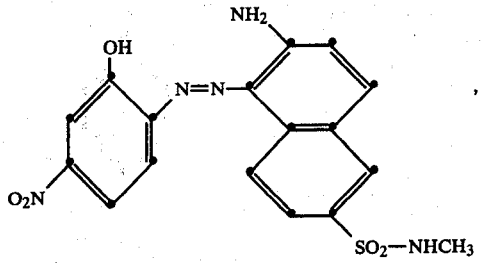

105 g of the dye of the formula

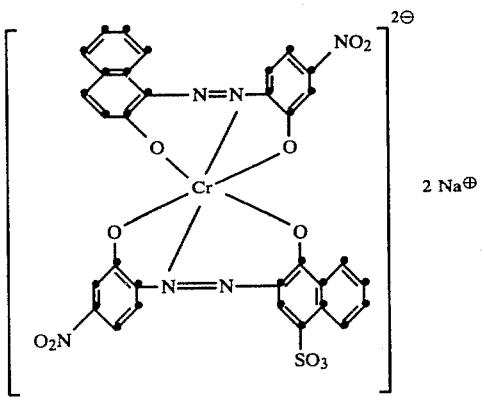

21.1 g of the 1:2 chromium complex of the dye of the formula

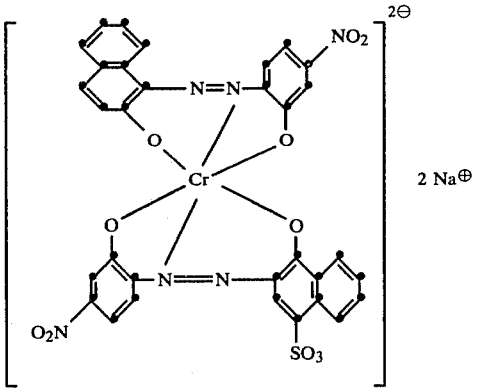

and 35 g of the dye of the formula

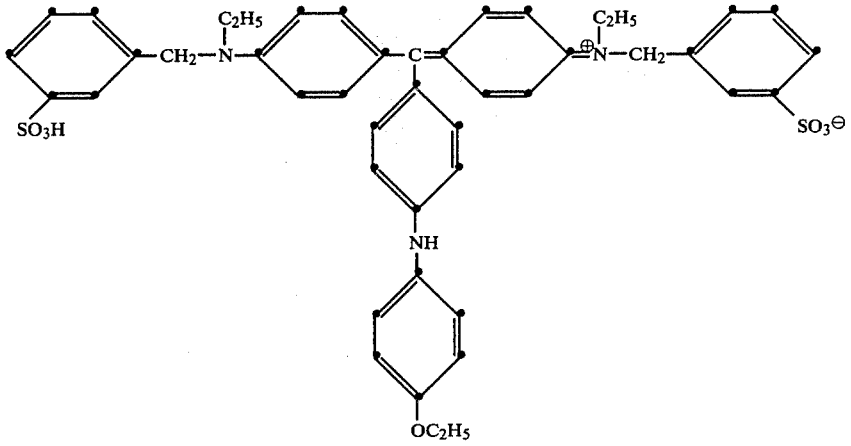

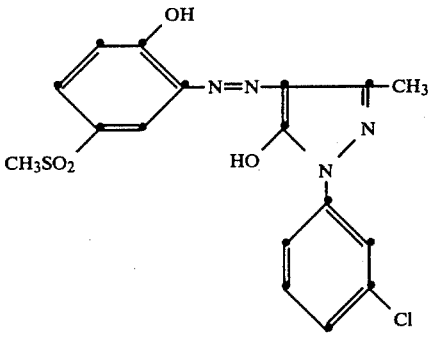

225 g of the 1:2 chromium complex dye of the formula are added after 10 minutes. The temperature is raised in the course of 45 minutes to 103° C., and dyeing is carried out at this temperature for 20 minutes. The cheeses are then rinsed, hydroextracted and dried. This gives a pale blue dyeing of the wool yarn of good non-skitteriness and levelness. The pH during the dyeing is between 5.0 and 5.2. The degree of exhaustion is 99.8%.

EXAMPLE 15

In a cheese-dyeing apparatus, springs are loaded with 16 kg of wool yarn and wetted at 50° C. in 128 liters of water. 128 g of sodium acetate, 320 g of 60% acetic acid, 850 g of sodium sulfate and 160 g of the dyeing assistant mixture $A_4$ are then added. 18 g of the 1:2 cobalt complex of the dye of the formula

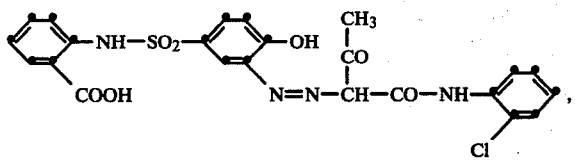
19 g of the 1:2 chromium complex of the dye of the formula
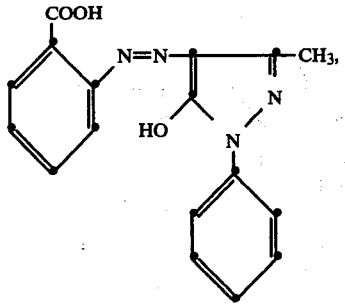
12.3 g of the 1:2 chromium complex of the dyes of the formulae
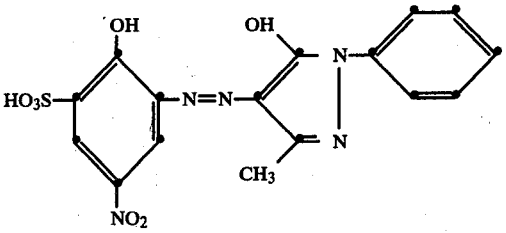
and
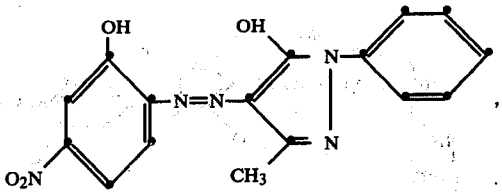
2.8 g of the 1:2 chromium complex of the dye of the formula
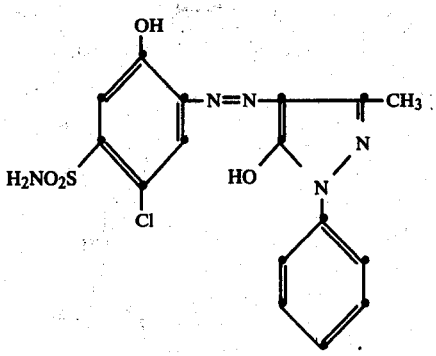
25.3 g of the dye of the formula
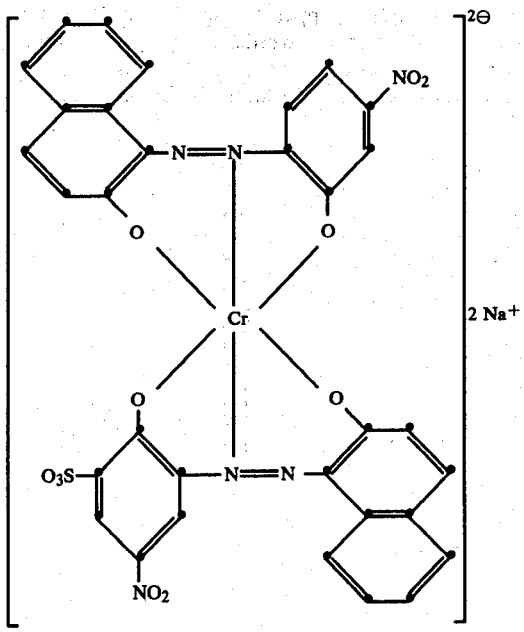
and 3.9 g of the dye of the formula

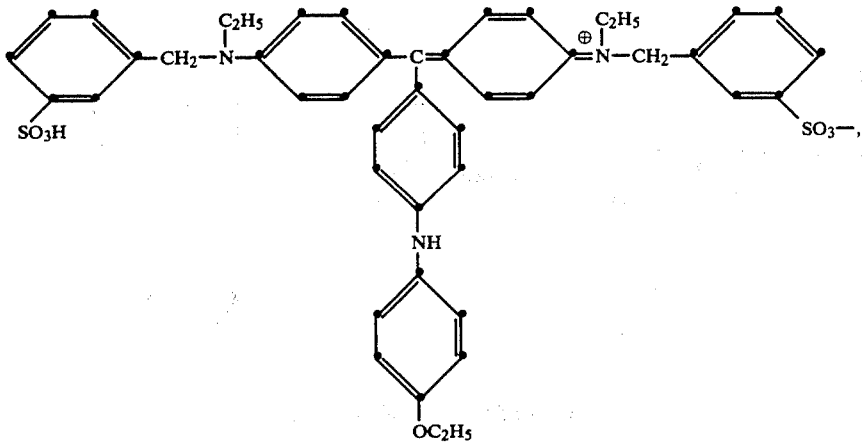

are added after 10 minutes. The pH of the dyebath is 6.5. 80 ml of 60% acetic acid are added, thereby adjusting the pH to 5.2. The temperature is raised in the course of 45 minutes to 103° C., and dyeing is carried out at this temperature for 20 minutes. The cheeses are then rinsed, hydroextracted and dried. This gives an olive dyeing of the wool yarn of good non-skitteriness and levelness. The pH at the end of the dyeing is 5.5. The degree of exhaustion is 98%.

EXAMPLE 16

In a cheese-dyeing apparatus, springs are loaded with 122 kg of wool yarn and wetted at 50° C. in 976 liters of water. 976 g of sodium acetate, 1,830 g of 60% acetic acid, 6.16 kg of calcined sodium sulfate and 1.22 kg of the dyeing assistant mixture $A_2$ are then added. 30.3 g of the 1:2 cobalt complex of the dye of the formula

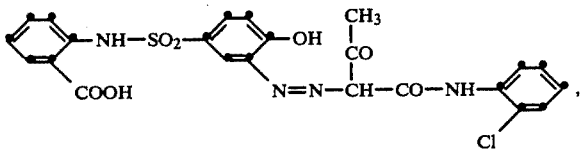

32 g of the 1:2 chromium complex of the dye of the formula

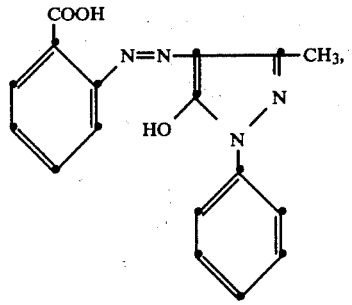

33 g of the dye of the formula

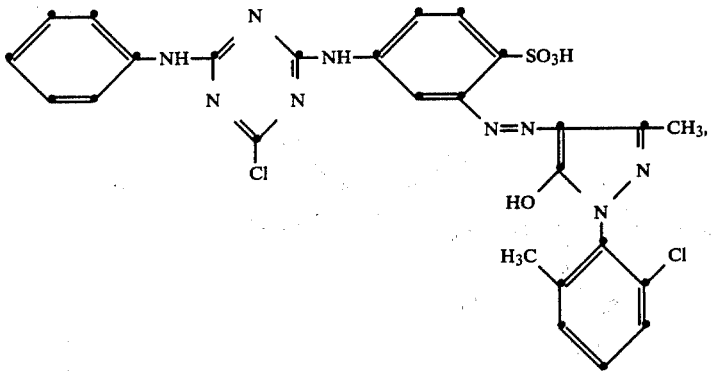

4.6 g of the dye of the formula

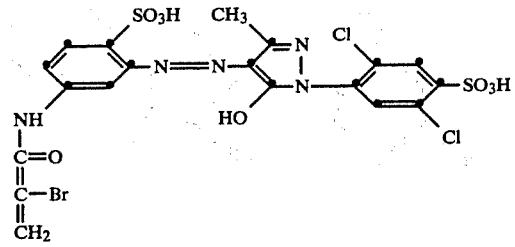

55 g of the 1:2 chromium complex of the dyes of the formulae

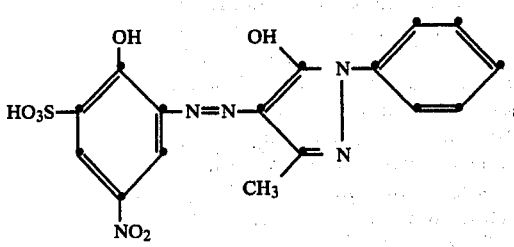

and

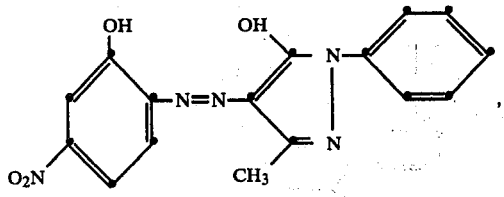

12.2 g of the 1:2 chromium complex of the dye of the formula

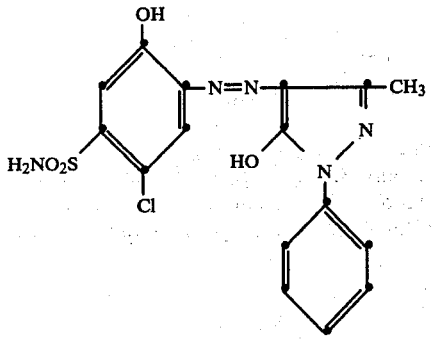

and 75 g of the dye of the formula

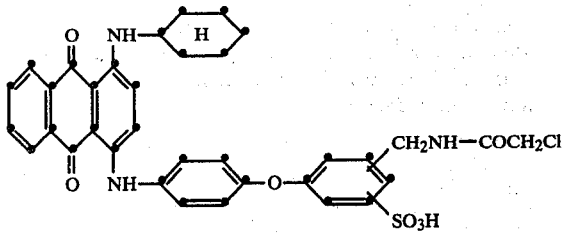

are added after 10 minutes. The temperature is raised in the course of 45 minutes to 103° C., and dyeing is carried out at this temperature for 20 minutes. The cheeses are then rinsed, hydroextracted and dried. This gives a beige dyeing of the wool yarn of good non-skitteriness and levelness. The pH during the dyeing is between 4.9 and 5.1. The degree of exhaustion is 99%.

EXAMPLE 17

In a cheese-dyeing apparatus, springs are loaded with 1,085 kg of wool yarn and wetted at 60° C. in 6,000 liters of water. 6 kg of sodium acetate, 21.7 kg of 60% acetic acid, 57.2 kg of sodium sulfate and 10.9 kg of the dyeing assistant mixture $A_1$ are then added. 13.6 kg of the dye of the formula

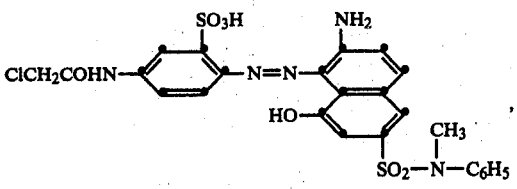

8.1 kg of the 1:2 chromium complex containing in the molecule one dye molecule each of the formulae

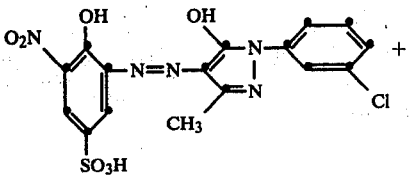

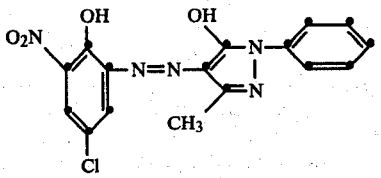

0.8 kg of the dye of the formula

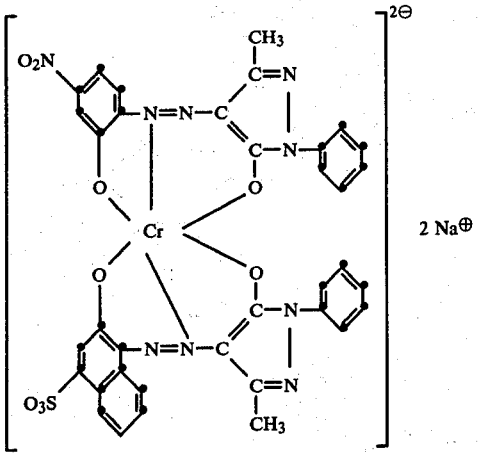

49 g of the 1:2 cobalt complex of the dye of the formula

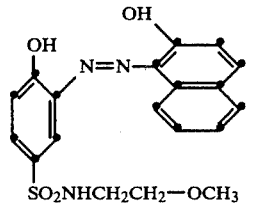

and 85 g of the dye of the formula

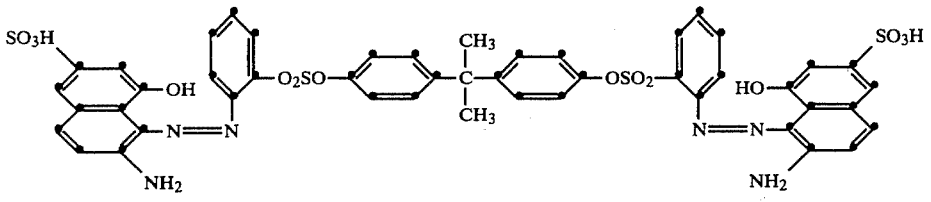

are added after 10 minutes. The temperature is raised in the course of 35 minutes to 103° C., and dyeing is carried out at this temperature for 20 minutes. The cheeses are then rinsed, hydroextracted and dried. This gives a red dyeing of the wool yarn of good non-skitteriness and levelness. The pH during the dyeing is between 4.9 and 5.1. The degree of exhaustion is 96%.

EXAMPLE 18

In a cheese-dyeing apparatus, springs are loaded with 140 kg of wool yarn and wetted at 60° C. in 840 liters of water. 840 g of sodium acetate, 4,200 g of 60% acetic acid, 7,200 g of calcined sodium sulfate and 2,800 g of the dyeing assistant mixture $A_3$ are then added. 850 g of the dye of the formula

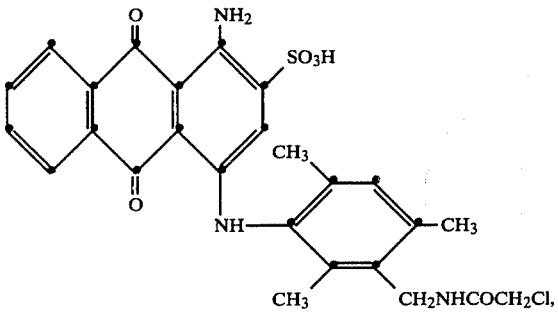

and 153 g of the dye of the formula

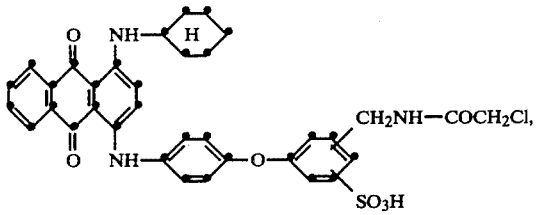

are added after 20 minutes. The temperature is raised in the course of 40 minutes to 104° C., and dyeing is carried out at this temperature for 20 minutes. The cheeses are then rinsed, hydroextracted and dried. This gives a blue dyeing of the wool yarn of good non-skitteriness and levelness. The pH during the dyeing is between 4.8 and 5.0. The degree of exhaustion is 95%.

What is claimed is:

1. A process for the non-skittery and level dyeing of fibre material made of natural polyamides with dyes or mixtures of dyes in the presence of a mixture of dyeing assistants, which comprises using for dyeing said material an aqueous liquor which contains at least one anionic wool dye which, under the dyeing conditions defined below, at 1/1 standard depth, exhausts to at least 95%, and a dyeing assistant mixture containing an anionic compound of the formula

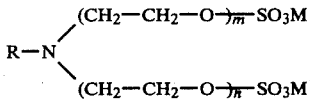

(1)

in which R is an alkyl or alkenyl radical having 12 to 22 carbon atoms, M is hydrogen, an alkali metal or ammonium, and m and n are integers such that the sum of m and n is 2 to 14, a quaternary compound of the formula

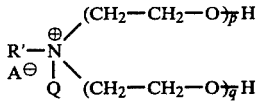

(2)

in which R' is an alkyl or alkenyl radical having 12 to 22 carbon atoms, A is an anion, Q is a substituted or unsubstituted alkyl radical, and p and q are integers such that the sum of p and q is 20 to 50, and a non-ionic compound of the formula

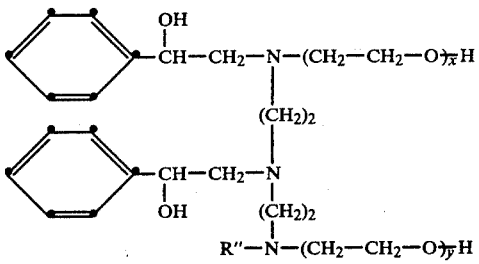

(3)

in which R'' is an alkyl or alkenyl radical having 12 to 22 carbon atoms, and x and y are integers such that the sum of x and y is 80 to 140, and which liquor can also contain an ammonium or alkali metal salt, and finishing the dyeing regardless of its depth at pH 4.5–5.5 and at a temperature of 95° to 105° C.

2. A process according to claim 1, wherein the anionic wool dyes are triphenylmethane dyes having at least two sulfonic acid groups, monoazo and disazo dyes which are free of heavy metal but either of which have one or more sulfonic acid groups and can contain one or more fibre-reactive groups, heavy metal-containing monoazo, disazo, azomethine and formazan dyes, and anthraquinone dyes.

3. A process according to claim 2, wherein the anionic wool dyes are dyes or mixtures of dyes of the formulae (4) to (8)

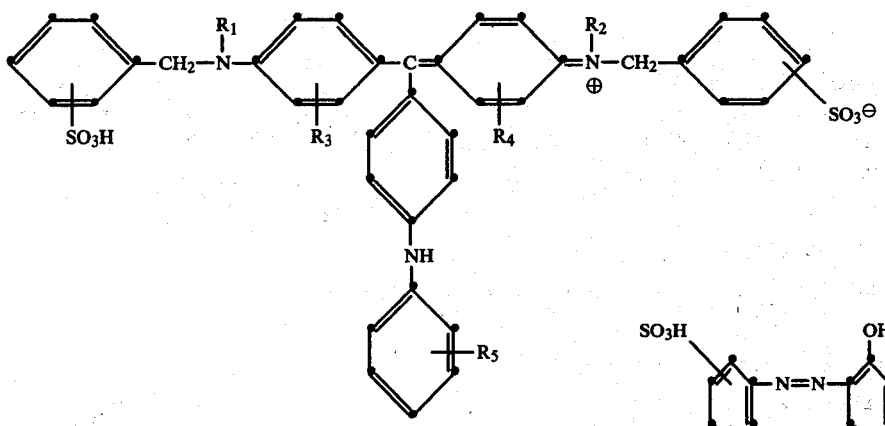

(4)

in which $R_1$, $R_2$, $R_3$ and $R_4$ independently of each other are $C_{1-4}$-alkyl and $R_5$ is $C_{1-4}$-alkyl, $C_{1-4}$-alkoxy or hydrogen,

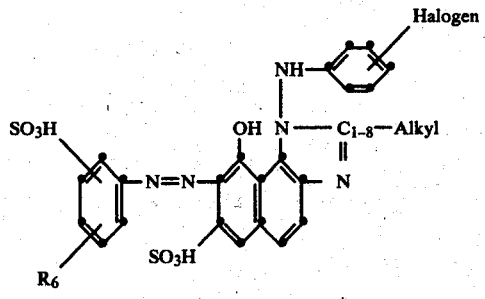

(7)

in which $R_6$ is as defined under formula (5),

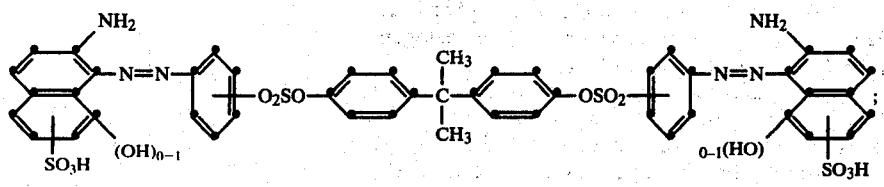

(8)

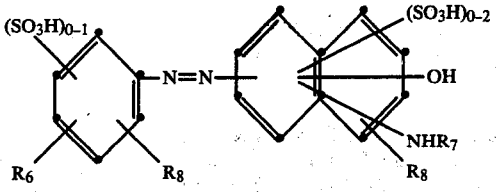

(5)

in which $R_6$ is a fibre-reactive group bonded via a —NH— group, benzoylamino, phenoxy, chlorophenoxy, dichlorophenoxy or methylphenoxy, $R_7$ is hydrogen, benzoyl, phenyl, $C_{1-4}$-alkyl, phenylsulfonyl, methylphenylsulfonyl or a fibre-reactive group which is or is not bonded via aminobenzoyl, and the substituents $R_8$ are independently of each other hydrogen or a phenylaminosulfonyl or N-phenyl-N-methylaminosulfonyl radical,

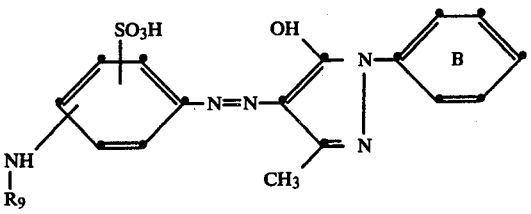

(6)

in which $R_9$ is a fibre-reactive group and the phenyl ring B can be substituted by halogen, $C_{1-4}$-alkyl and sulfo, the 1:2 chromium complex dyes of the azo and azomethine dyes of the formula (9)

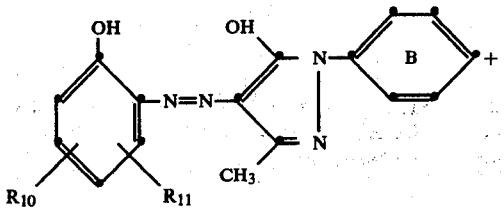

(9)

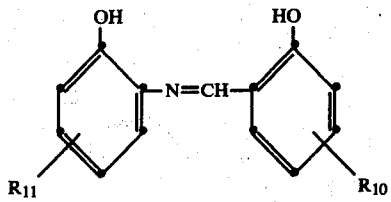

in which $R_{10}$ is hydrogen, sulfo or phenylazo, $R_{11}$ is hydrogen or nitro, and the phenyl ring B can contain the substituents specified under formula (6); the symmetrical 1:2 chromium complex dyes of azo dyes of the formulae (10) and (11)

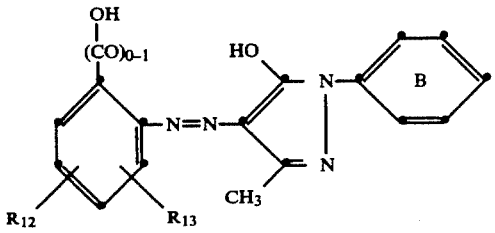

(10)

in which the phenyl ring B can contain the substituents specified under formula (6) and $R_{12}$ and $R_{13}$ independently of each other are hydrogen, nitro, sulfo, halogen, $C_{1-4}$-alkylsulfonyl, $C_{1-4}$-alkylaminosulfonyl or $-SO_2NH_2$;

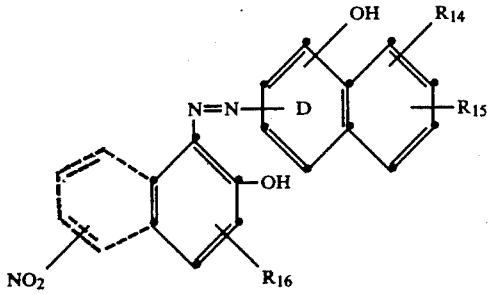

(11)

in which $R_{14}$ is hydrogen, $C_{1-4}$-alkoxycarbonylamino, benzoylamino, $C_{1-4}$-alkylsulfonylamino, phenylsulfonylamino, methylphenylsulfonylamino or halogen, $R_{15}$ is hydrogen or halogen, and $R_{16}$ is $C_{1-4}$-alkylsulfonyl, $C_{1-4}$-alkylaminosulfonyl, phenylazo, sulfo or $-SO_2NH_2$, and where the hydroxyl group in the benzo ring D is bonded in o-position relative to the azo bridge to the benzo ring D; the symmetrical 1:2 cobalt complexes of azo dyes of the formulae (12) and (13)

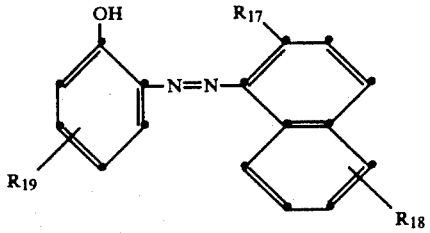

(12)

in which $R_{17}$ is the —OH or $NH_2$ group, $R_{18}$ is hydrogen or $C_{1-4}$-alkylaminosulfonyl, and $R_{19}$ is nitro or $C_{1-4}$-alkoxy-$C_{1-4}$-alkyleneaminosulfonyl,

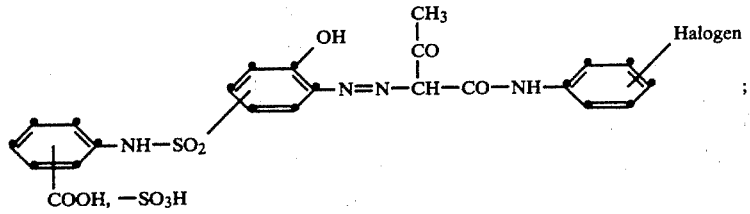

(13)

the asymmetrical 1:2 chromium complex dyes of the azo dyes of the formulae (14) to (19)

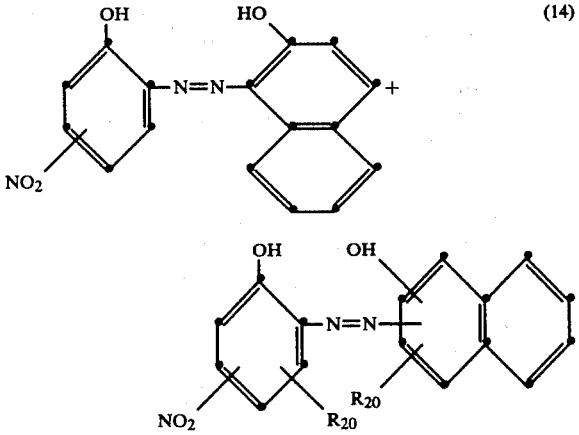

(14)

in which one of the substituents $R_{20}$ is hydrogen and the other is sulfo,

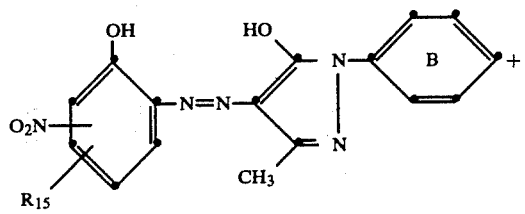

(15)

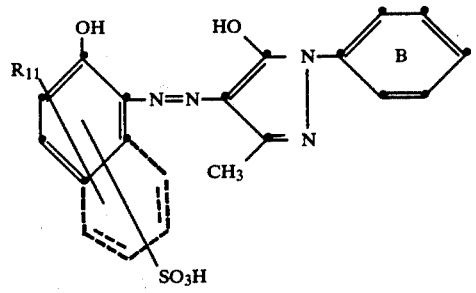

in which $R_{11}$ is as defined under formula (9) and $R_{15}$ is as defined under formula (11), and the phenyl rings B independently of each other can contain the substituents specified under formula (6),

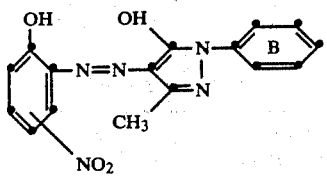

(16)

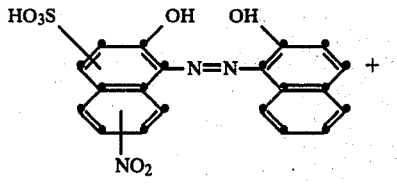

(17)

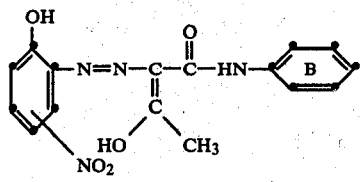

(18)

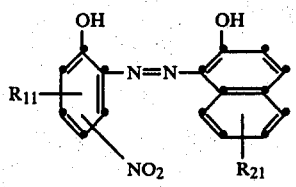

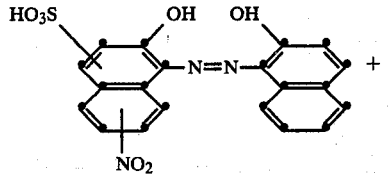

(19)

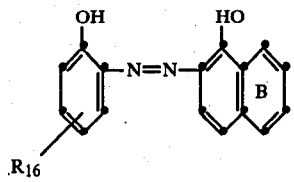

in which the phenyl ring B in the formulae (16), (17) and (19) can contain the substituents specified under formula (6), $R_{11}$ is as defined under formula (9), $R_{21}$ is hydrogen, methoxycarbonylamino or acetylamino, and $R_{16}$ is as defined under formula (11); 1:2 chromium complex dyes of the azo dyes of the formulae (10)+(11); 1:2 chromium mixed complexes of the azo dyes of the formulae (10) and (11); anthraquinone dyes of the formulae (20) to (22)

(20)

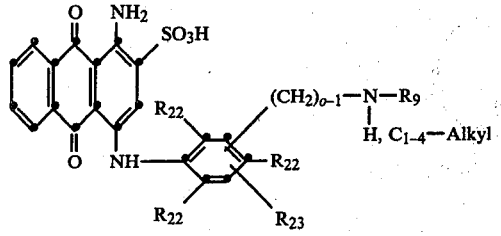

in which $R_9$ is as defined under formula (6), the $R_{22}$s independently of each other are hydrogen or $C_{1-4}$-alkyl, and $R_{23}$ is hydrogen or sulfo;

(21)

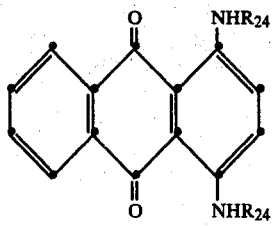

in which the substituents $R_{24}$ independently of each other are cyclohexyl or the diphenyl ether radical which can be substituted by sulfo or the radical $—CH_2NH—R_9$ in which $R_9$ is as defined under formula (6); and (22)

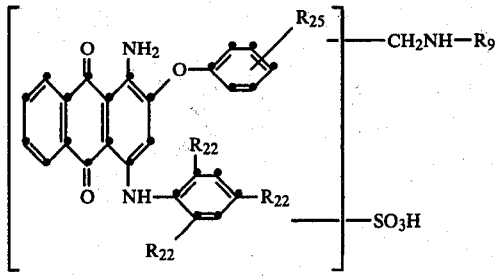

in which $R_9$ is as defined under formula (6), $R_{22}$ is as defined under formula (20), and $R_{25}$ is $C_{4-8}$-alkyl.

4. A process according to claim 3 for trichromatic dyeing, which comprises using a mixture of at least three anionic wool dyes from among yellow- or orange-, red- and blue-dyeing dyes.

5. A process according to claim 1, wherein anionic wool dyes are used which, at 1/1 standard depth, exhaust to at least 97%.

6. A process according to claim 1, wherein a mixture of dyeing assistants is used which contains 5 to 70 parts of compounds of the formula (1), 15 to 60 parts of the compound of the formula (2) and 5 to 60 parts of the compound of the formula (3), relative to 100 parts of the mixture of dyeing assistants, and where in the formulae (1), (2) and (3), R, R' and R'' independently of one another are an alkyl or alkenyl radical having 16 to 22 carbon atoms.

7. A process according to claim 1, wherein a compound of the formula (2) is used in which A and Q are derived from the quaternising agents chloroacetamide, ethylenechlorohydrin, ethylenebromohydrin, epichlorohydrin, epibromohydrin or dimethyl sulfate.

8. A process according to claim 1, wherein a mixture of dyeing assistants is used which, in addition to compounds of the formulae (1), (2) and (3), also contains an adduct of 60 to 100 parts of ethylene oxide on a $C_{15-20}$-alkenyl alcohol.

9. A process according to claim 1, wherein 0.5 to 2 percent by weight, relative to the fibre material, of the dyeing assistant mixture is used and wherein the ammonium or alkali metal salt is an ammonium or alkali metal sulfate.

10. A process according to claim 9, wherein 0.1 to 10 percent by weight of ammonium or an alkali metal sulfate relative to the fibre material is used.

11. A process according to claim 1, wherein the dyeing is carried out regardless of its depth at pH 4.6–4.9 and a liquor ratio of 5:1 to 40:1.

12. A process according to claim 1, wherein wool is the natural polyamide fibre material.
13. A process according to claim 3, which comprises using dyes of the formulae (62) to (65)
(62)
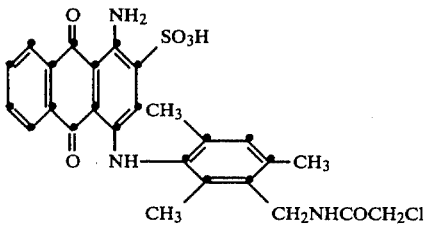
(63)
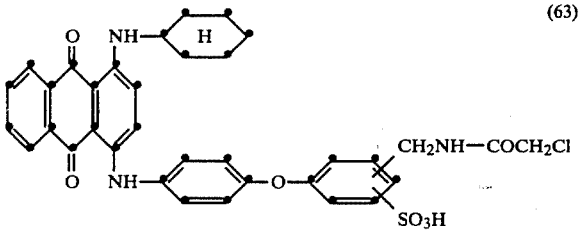
(64)
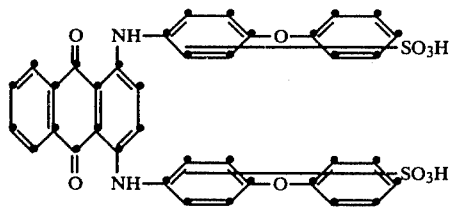
(65)
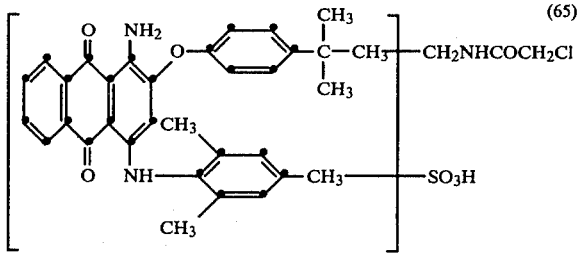
and mixtures of dyes of the formulae (24)+(39)
(24)
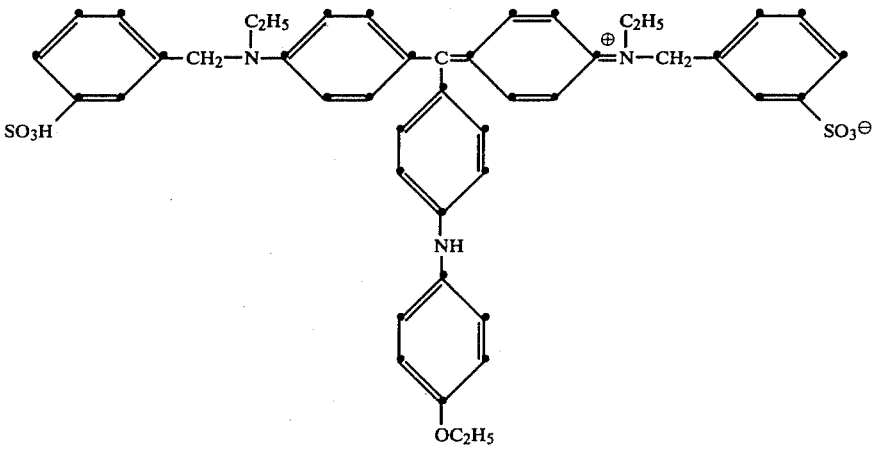

(39)
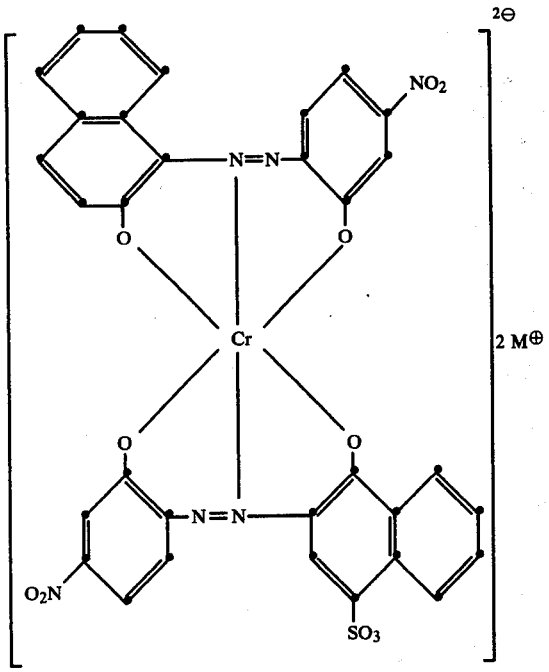
mixtures of dyes of the formulae (25)+(42)
(25)
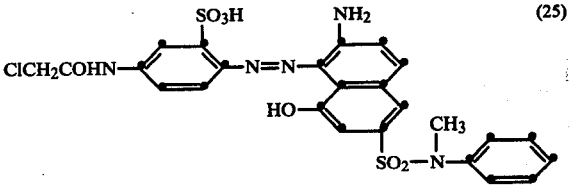
(42)
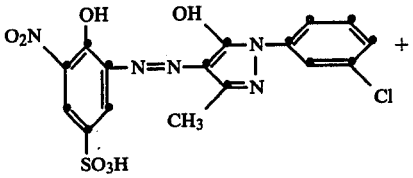
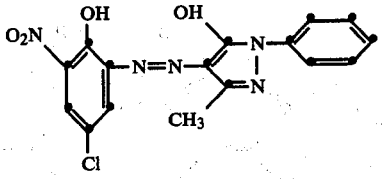
1:2 chromium complex
mixtures of dyes of the formulae (26)+(27)
(26)
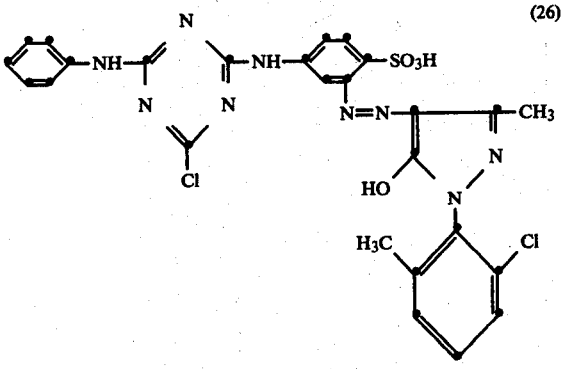
(27)
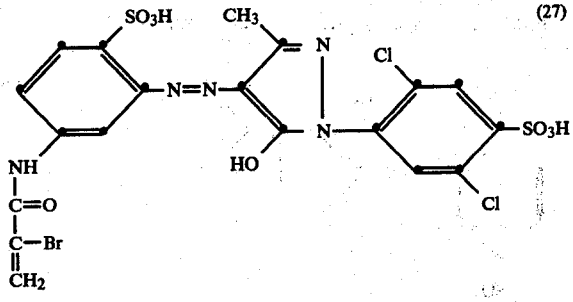
mixtures of dyes of the formulae (31)+(38)
(31)
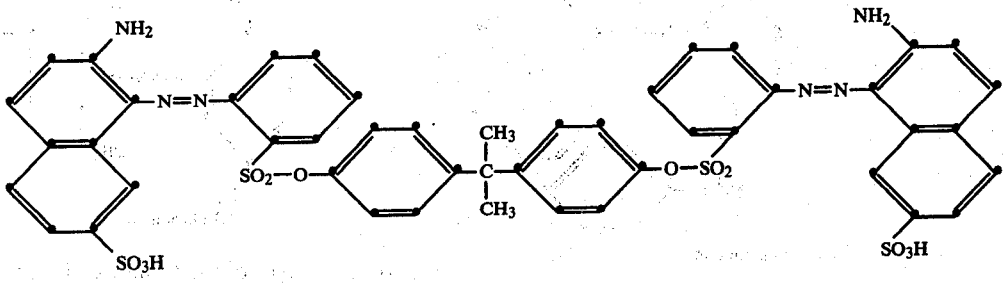

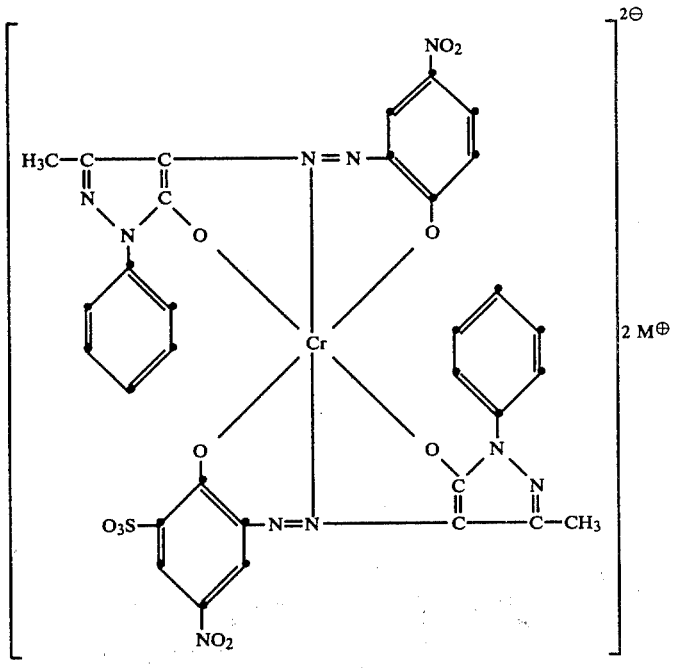
(38)
mixtures of dyes of the formulae (40)+(44)
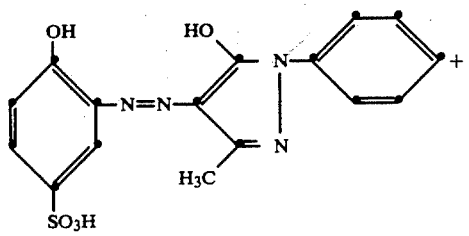
(40)
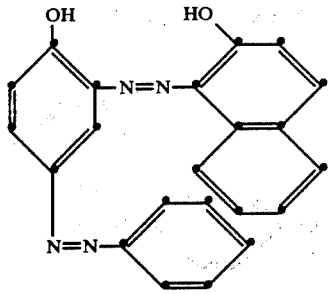
1:2 chromium complex
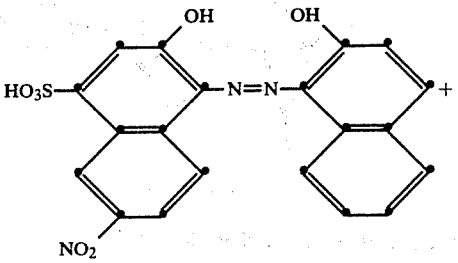
(44)
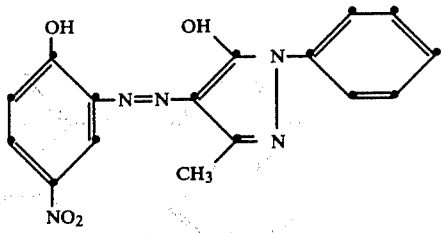
1:2 chromium complex
mixtures of dyes of the formulae (41)+(54)

(41)
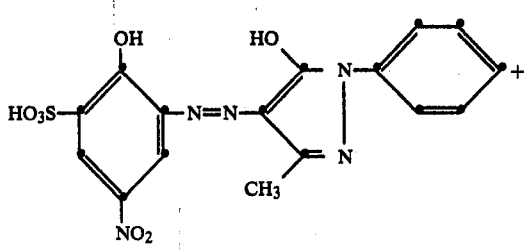
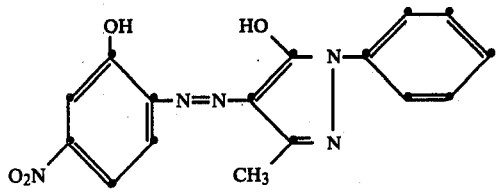
1:2 chromium complex
(54)
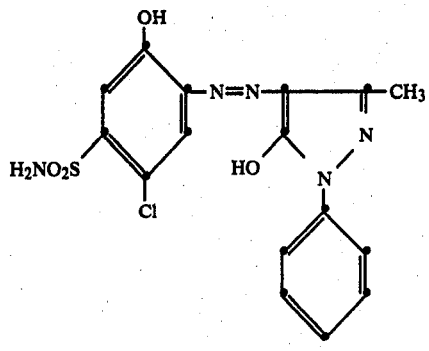
1:2 chromium complex
mixtures of dyes of the formulae (32)+(37)+(56)
(32)
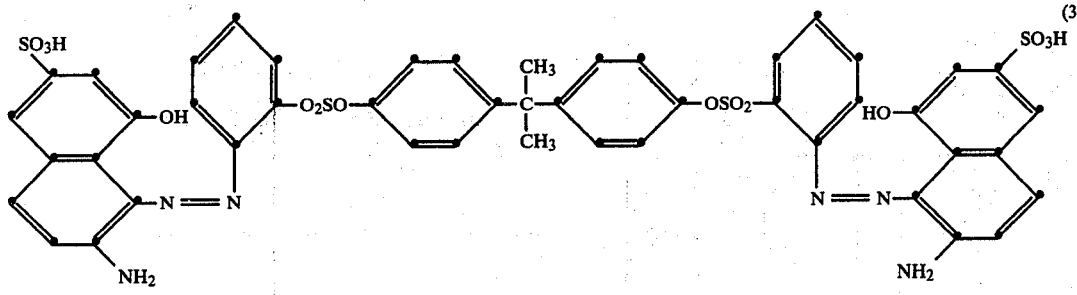
(37)
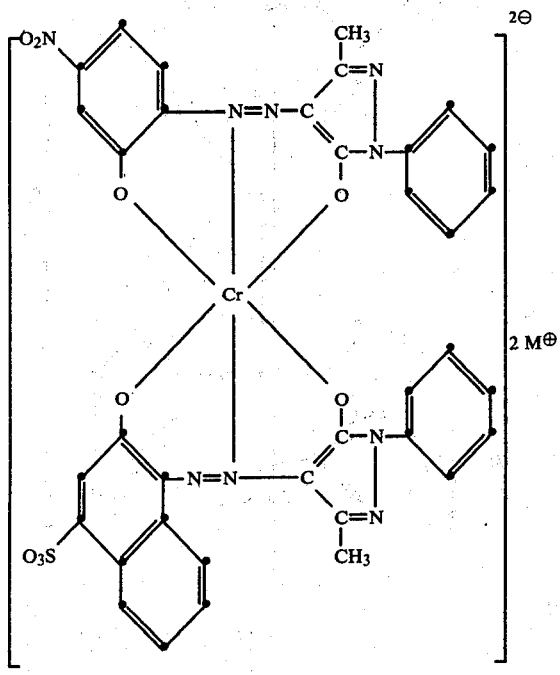

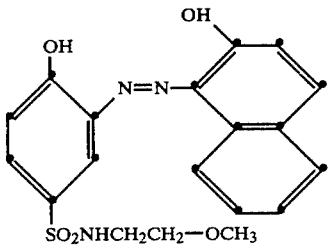
(56)
1:2 cobalt complex
mixtures of dyes of the formulae (35)+(39)+(53)+(57)
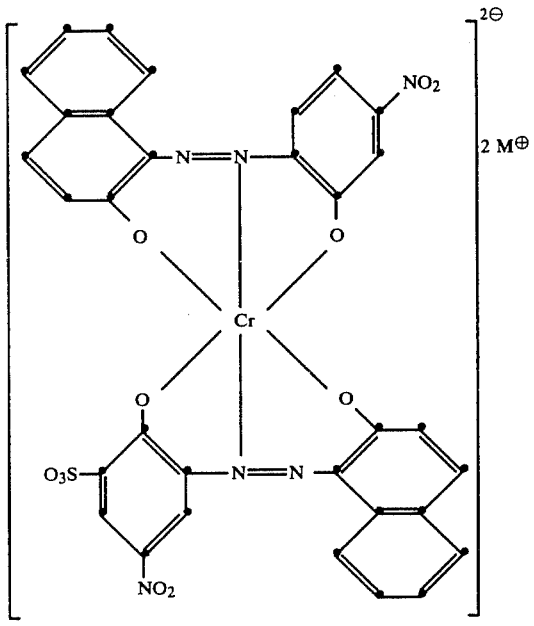
(35)
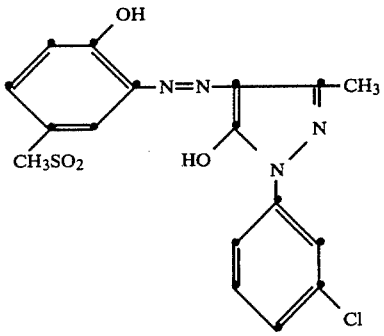
(53)
1:2 chromium complex
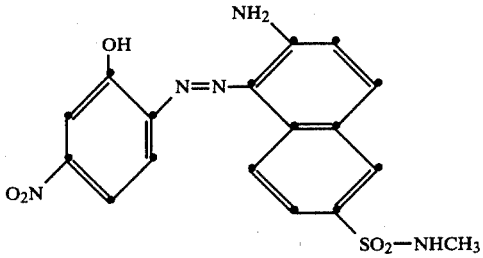
(57)
1:2 cobalt complex
mixtures of dyes of the formulae (36)+(51)+(53)
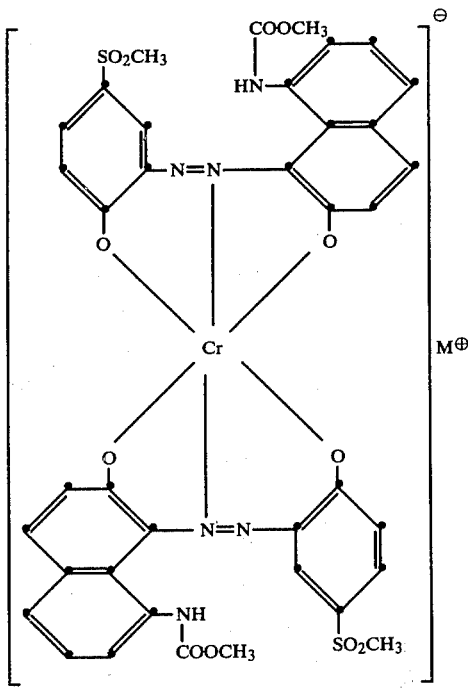
(36)

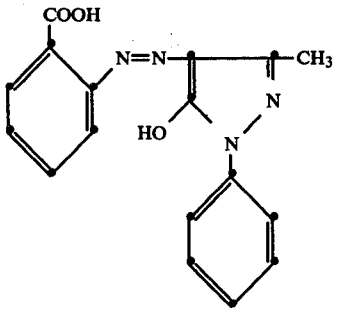
(51) mixtures of dyes of the formulae (43)+(45)+(46)+(47)+(48)+(49)
1:2 chromium complex
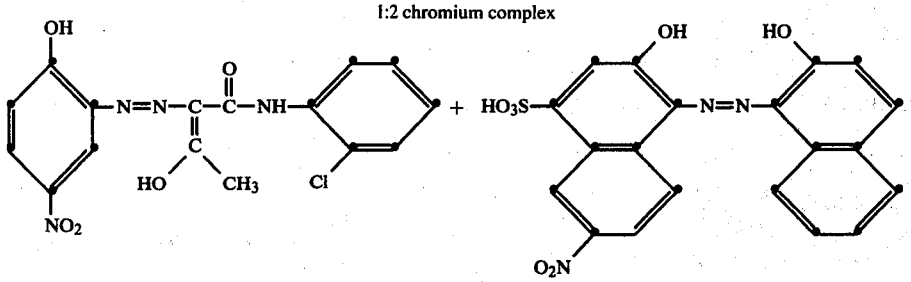
(43)
1:2 chromium complex
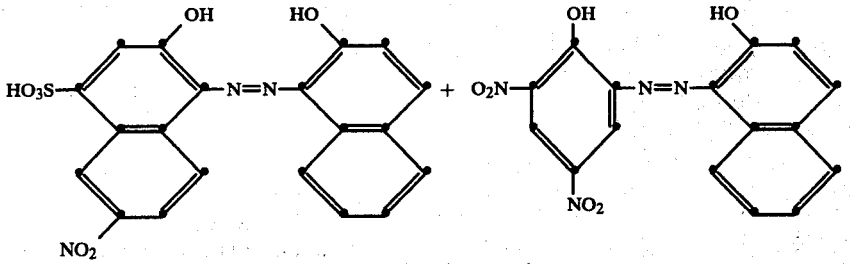
(45)
1:2 chromium complex
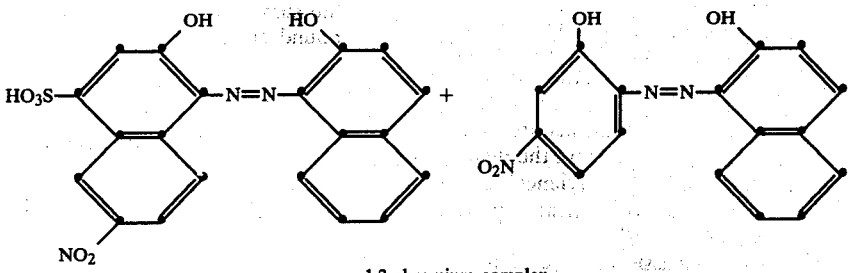
(46)
1:2 chromium complex
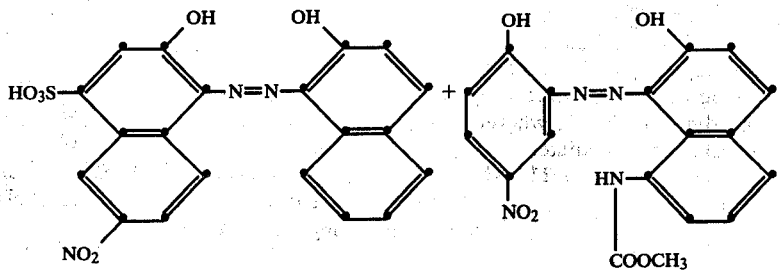
(47)
1:2 chromium complex
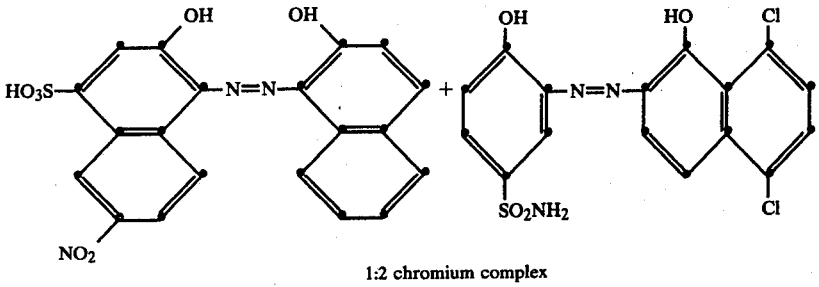
(48)
1:2 chromium complex

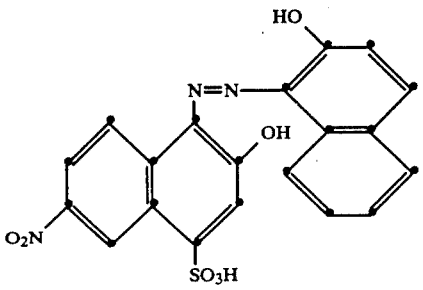

1:2 chromium complex (49)

and mixtures of dyes of the formulae (51)+(55)

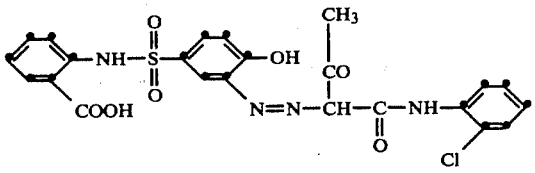

(55)

where M⊕ in the formulae (35) to (39) is an alkali metal ion, alkaline earth metal ion or ammonium ion.

14. A process according to claim 1, which comprises dyeing from an aqueous liquor by the exhaust method at temperatures between 98° and 103° C.

15. A natural polyamide dyed according to claim 1.

16. A mixture of dyeing assistants according to claim 1, which contains 5 to 70 parts of the compound of the formula (1), 15 to 60 parts of the compound of the formula (2) and 5 to 60 parts of the compound of the formula (3) relative to 100 parts of the mixture of dyeing assistants and in which R, R' and R'' in the formulae (1), (2) and (3) independently of one another are an alkyl or alkenyl radical having 16 to 22 carbon atoms.

17. A mixture of dyeing assistants according to claim 1, in which A and Q are derived from the quaternising agents chloroacetamide, ethylenechlorohydrin, ethylenebromohydrin, epichlorohydrin, epibromohydrin or dimethyl sulfate.

18. A mixture of dyeing assistants according to claim 1, which, in addition to compounds of the formulae (1), (2) and (3), also contains an adduct of 60 to 100 parts of ethylene oxide on a $C_{15-20}$-alkenyl alcohol.

19. A process according to claim 9, wherein 1 percent by weight of the dyeing assistant mixture is used.

20. A process according to claim 9, wherein sodium sulfate is used as the alkali metal sulfate.

21. A process according to claim 11, wherein the liquor ratio is 8:1 to 25:1.

22. A mixture of dyeing assistants which contains an anionic compound of the formula

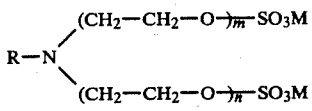

(1)

in which R is an alkyl or alkenyl radical having 12 to 22 carbon atoms, M is hydrogen, an alkali metal or ammonium, and m and n are integers such that the sum of m and n is 2 to 14, a quaternary compound of the formula

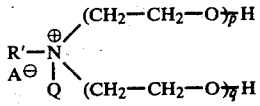

(2)

in which R' is an alkyl or alkenyl radical having 12 to 22 carbon atoms, A is an anion, Q is a substituted or unsubstituted alkyl radical, and p and q are integers such that the sum of p and q is 20 to 50, and a non-ionic compound of the formula

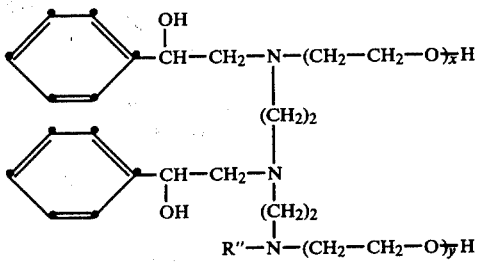

(3)

in which R'' is an alkyl or alkenyl radical having 12 to 22 carbon atoms, and x and y are integers such that the sum of x and y is 80 to 140.

23. A process for dyeing a natural polyamide wherein the dyeing assistant mixture of claim 1 is used as a dyeing assistant.

* * * * *

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Column 4, correct the formula appearing at lines 55 to 66 as follows:

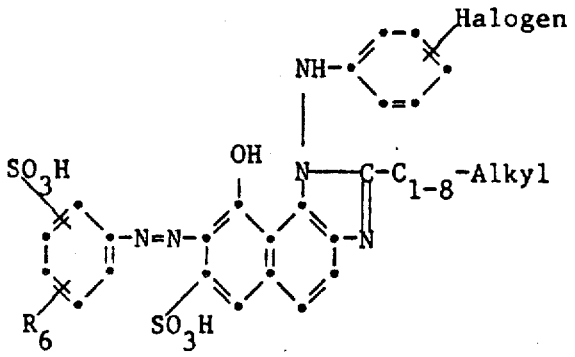

(7)

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Column 7, line 50 to column 8, line 29, correct the formulas to read as follows:

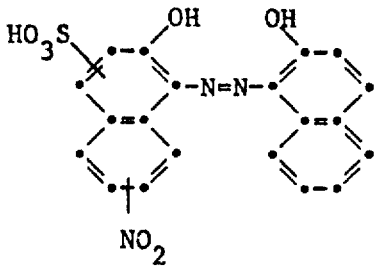

+

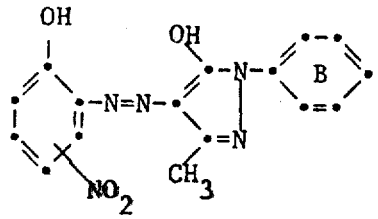

(16)

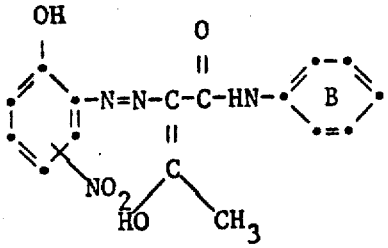

(17)

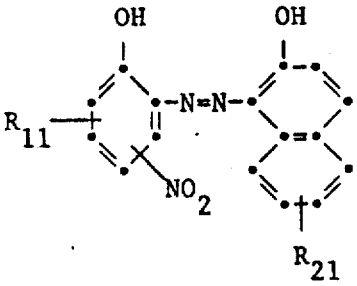

(18)

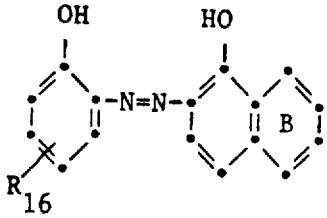

(19)

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Column 26, line 46, correct the spelling of "octadecenylamine".

Column 56, correct the formula appearing at lines 56 to 65 to read as follows:

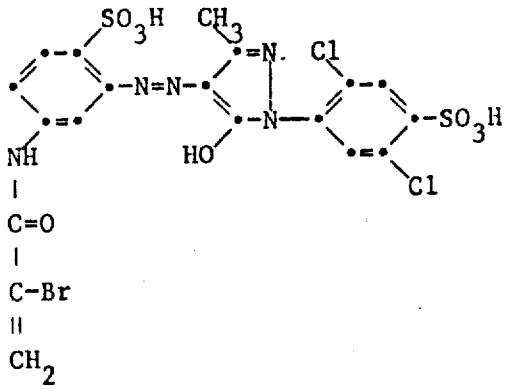

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Column 62, correct lines 2 to 27 to read as follows:

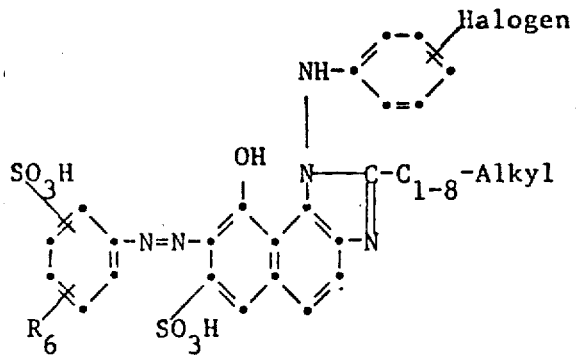

(7)

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Correct the portion of the patent extending from column 64, line 50 to column 65, line 39 to read as follows:

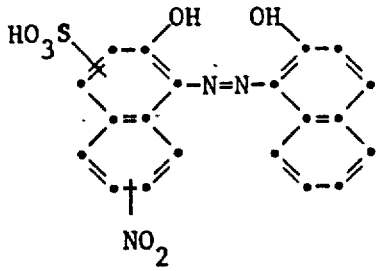

+

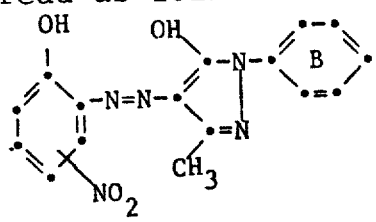

(16)

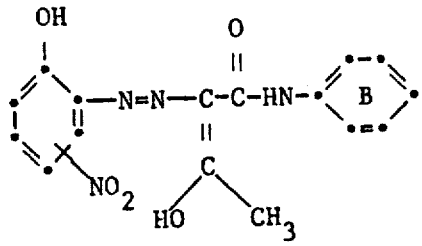

(17)

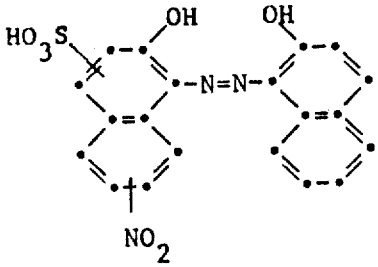

+

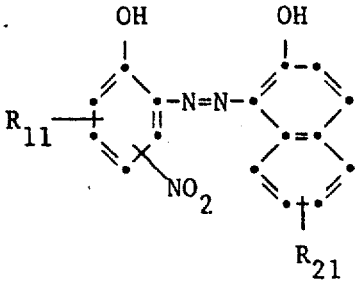

(18)

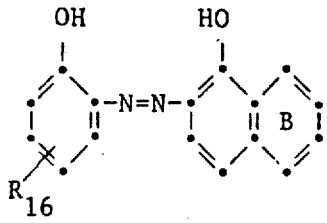

(19)

UNITED STATES PATENT AND TRADEMARK OFFICE

CERTIFICATE OF CORRECTION

PATENT NO. : 4,444,564 Page 6 of 8

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Column 75, correct the formula appearing at lines 55 to 66 to read as follows:

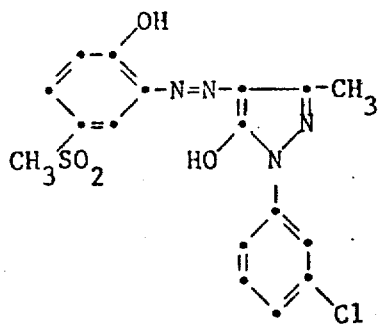

1:2 chromium complex

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

In column 77, the first formula and its associated label should be shown as follows:

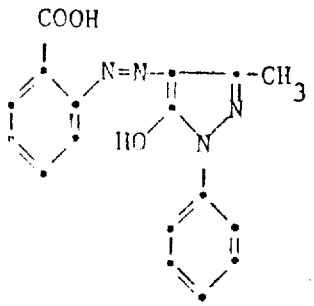

(51)

1:2 chromium complex

The wording "1:2 chromium complex" appearing immediately above the second formula in column 77 and the first formula in column 78 should be deleted.

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN FLENSBERG, HARRY SCHAETZER

It is certified that error appears in the above-identified patent and that said Letters Patent is hereby corrected as shown below:

Column 79, line 33, change "1" to --22--;
line 41, change "1" to --22--;
line 46, change "1" (first occurrence) to --22--.

Column 80, line 54, change "1" to --22--.

Signed and Sealed this

*Twelfth* Day of *November 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,444,564

DATED : April 24, 1984

INVENTOR(S) : HEINZ SALATHE, HERMANN ELENSBERG and HARRY SCHAETZER

It is certified that error appears in the above-identified patent and that said Letters Patent is hereby corrected as shown below:

Column 6, correct the formula appearing at line 20 to read as follows:

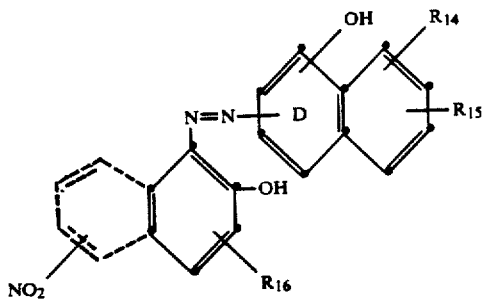

Signed and Sealed this

Ninth Day of October, 1990

*Attest:*

HARRY F. MANBECK, JR.

*Attesting Officer*

*Commissioner of Patents and Trademarks*